US009109760B2

(12) United States Patent
Shum et al.

(10) Patent No.: US 9,109,760 B2
(45) Date of Patent: Aug. 18, 2015

(54) ACCESSORIES FOR LED LAMPS

(71) Applicant: SORAA, INC., Fremont, CA (US)

(72) Inventors: Frank Tin Chung Shum, Sunnyvale, CA (US); Artem Mishin, Pacifica, CA (US); Zinovy Dolgonosov, San Francisco, CA (US); Clifford Jue, Santa Cruz, CA (US); Abdul Assaad, Fremont, CA (US)

(73) Assignee: Soraa, Inc., Fremont, CA (US)

( * ) Notice: Subject to any disclaimer, the term of this patent is extended or adjusted under 35 U.S.C. 154(b) by 0 days.

(21) Appl. No.: 14/014,112

(22) Filed: Aug. 29, 2013

(65) Prior Publication Data

US 2013/0343062 A1 Dec. 26, 2013

Related U.S. Application Data

(63) Continuation-in-part of application No. 13/915,432, filed on Jun. 11, 2013, which is a continuation-in-part of application No. 13/480,767, filed on May 25, 2012.

(60) Provisional application No. 61/659,386, filed on Jun. 13, 2012, provisional application No. 61/530,832, filed on Sep. 2, 2011.

(51) Int. Cl.

| | |
|---|---|
| ***F21K 99/00*** | (2010.01) |
| ***F21V 17/10*** | (2006.01) |
| ***F21V 29/83*** | (2015.01) |

(52) U.S. Cl.

CPC ... *F21K 9/50* (2013.01); *F21K 9/13* (2013.01); *F21V 17/105* (2013.01); *F21V 29/83* (2015.01)

(58) Field of Classification Search

CPC ..... F21V 17/105; F21V 29/83; F21K 9/50; F21K 9/13

See application file for complete search history.

(56) References Cited

U.S. PATENT DOCUMENTS 2,953,970 A * 9/1960 Maynard ..... 359/611
3,283,143 A 11/1966 Gosnell (Continued)

FOREIGN PATENT DOCUMENTS

CN 2826150 Y 10/2006
CN 2009-75612 11/2007

(Continued)

OTHER PUBLICATIONS

Nakamura, 'Candela-Class High-Brightness InGaN/AlGaN Double-Heterostructure Blue-Light-Emitting Diodes', Applied Physics Letters, vol. 64, No. 13, Mar. 1994, pp. 1687-1689.

(Continued)

*Primary Examiner* — Thomas A Hollweg
(74) *Attorney, Agent, or Firm* — Saul Ewing LLP

(57) ABSTRACT

Accessories for LED lamps and methods of attaching accessories to illumination sources (e.g., LED lamps) are disclosed. A beam shaping accessories mechanically affixed to the LED lamp. The lens is designed to adapt to a first fixture that is mechanically attached to the lens. Accessories are designed to have a second fixture for mating to the first fixture such that the first fixture and the second fixture are configured to produce a retaining force between the first accessory and the lens. In some embodiments, the retaining force is a mechanical force that is accomplished by mechanical mating of mechanical fixtures. In other embodiments, the retaining force is a magnetic force and is accomplished by magnetic fixtures configured to have attracting magnetic forces. In some embodiments, the accessory is treated to modulate an emanated light pattern (e.g., a rectangular, or square, or oval, or circular or diffused emanated light pattern).

26 Claims, 28 Drawing Sheets

(56) References Cited

U.S. PATENT DOCUMENTS

| | | | | |
|---|---|---|---|---|
| 3,593,021 | A * | 7/1971 | Auerbach | 362/434 |
| 3,621,233 | A | 11/1971 | Ferdinand et al. | |
| 4,165,919 | A * | 8/1979 | Little | 359/234 |
| 4,225,904 | A | 9/1980 | Linder | |
| 4,279,463 | A * | 7/1981 | Little | 359/399 |
| 4,293,892 | A * | 10/1981 | Plummer | 362/17 |
| 5,005,109 | A | 4/1991 | Carleton | |
| 5,764,674 | A | 6/1998 | Hibbs-Brenner et al. | |
| 6,116,758 | A * | 9/2000 | Lin | 362/364 |
| 6,204,602 | B1 | 3/2001 | Yang et al. | |
| 6,501,154 | B2 | 12/2002 | Morita et al. | |
| D471,881 | S | 3/2003 | Hegde | |
| 6,787,999 | B2 | 9/2004 | Stimac et al. | |
| 6,889,006 | B2 | 5/2005 | Kobayashi | |
| 6,942,368 | B1 * | 9/2005 | Kane et al. | 362/457 |
| 6,964,877 | B2 | 11/2005 | Chen et al. | |
| 7,207,694 | B1 * | 4/2007 | Petrick | 362/240 |
| D545,457 | S | 6/2007 | Chen | |
| 7,311,417 | B1 | 12/2007 | Lemke | |
| 7,344,279 | B2 | 3/2008 | Mueller et al. | |
| D581,583 | S | 11/2008 | Peng | |
| 7,488,097 | B2 | 2/2009 | Reisenauer et al. | |
| 7,506,998 | B2 | 3/2009 | Ansems et al. | |
| D592,613 | S | 5/2009 | Plonski et al. | |
| 7,637,635 | B2 | 12/2009 | Xiao et al. | |
| 7,658,528 | B2 | 2/2010 | Hoelen et al. | |
| 7,663,229 | B2 | 2/2010 | Lu et al. | |
| 7,674,015 | B2 | 3/2010 | Chien | |
| D618,634 | S | 6/2010 | Lin et al. | |
| 7,744,259 | B2 | 6/2010 | Walczak et al. | |
| D619,551 | S | 7/2010 | Lin et al. | |
| 7,748,870 | B2 | 7/2010 | Chang et al. | |
| 7,824,075 | B2 | 11/2010 | Maxik | |
| 7,889,421 | B2 | 2/2011 | Narendran et al. | |
| 7,972,040 | B2 | 7/2011 | Li et al. | |
| 7,993,031 | B2 | 8/2011 | Grajcar | |
| 7,997,774 | B2 * | 8/2011 | Liddle | 362/398 |
| D652,564 | S | 1/2012 | Maxik | |
| 8,153,475 | B1 | 4/2012 | Shum et al. | |
| D662,899 | S | 7/2012 | Shum et al. | |
| D662,900 | S | 7/2012 | Shum et al. | |
| 8,220,970 | B1 * | 7/2012 | Khazi et al. | 362/294 |
| 8,227,962 | B1 | 7/2012 | Su | |
| 8,272,762 | B2 | 9/2012 | Maxik et al. | |
| 8,324,835 | B2 | 12/2012 | Shum et al. | |
| D674,960 | S | 1/2013 | Chen et al. | |
| 8,390,207 | B2 | 3/2013 | Dowling et al. | |
| 8,405,947 | B1 | 3/2013 | Green et al. | |
| 8,414,151 | B2 | 4/2013 | Allen et al. | |
| 8,525,396 | B2 | 9/2013 | Shum et al. | |
| 8,534,867 | B1 * | 9/2013 | Beadle | 362/235 |
| 8,579,470 | B1 * | 11/2013 | Leahy et al. | 362/249.02 |
| D694,722 | S | 12/2013 | Shum et al. | |
| 8,618,742 | B2 | 12/2013 | Shum et al. | |
| 8,643,257 | B2 | 2/2014 | Shum et al. | |
| 8,651,711 | B2 * | 2/2014 | Rudisill et al. | 362/398 |
| 8,680,787 | B2 | 3/2014 | Veskovic | |
| 8,746,918 | B1 | 6/2014 | Rubino | |
| 8,752,975 | B2 | 6/2014 | Rubino | |
| 8,803,452 | B2 | 8/2014 | Shum et al. | |
| 8,829,774 | B1 | 9/2014 | Shum et al. | |
| 8,884,517 | B1 | 11/2014 | Shum et al. | |
| 8,888,332 | B2 | 11/2014 | Martis et al. | |
| 2001/0021073 | A1 | 9/2001 | Leggo et al. | |
| 2003/0039122 | A1 | 2/2003 | Cao | |
| 2003/0058650 | A1 | 3/2003 | Shih | |
| 2004/0222427 | A1 | 11/2004 | Hsiung | |
| 2004/0264195 | A1 | 12/2004 | Chang et al. | |
| 2005/0174780 | A1 | 8/2005 | Park | |
| 2005/0214992 | A1 | 9/2005 | Chakraborty et al. | |
| 2006/0262545 | A1 | 11/2006 | Piepgras et al. | |
| 2006/0274529 | A1 | 12/2006 | Cao | |
| 2007/0007898 | A1 | 1/2007 | Bruning | |
| 2007/0158797 | A1 | 7/2007 | Lee | |
| 2007/0284564 | A1 | 12/2007 | Biwa et al. | |
| 2008/0002444 | A1 | 1/2008 | Shekhawat et al. | |
| 2008/0049399 | A1 | 2/2008 | Lu et al. | |
| 2008/0080137 | A1 | 4/2008 | Otsuki et al. | |
| 2008/0123341 | A1 | 5/2008 | Chiu | |
| 2008/0142781 | A1 | 6/2008 | Lee | |
| 2008/0158887 | A1 | 7/2008 | Zhu et al. | |
| 2008/0164489 | A1 | 7/2008 | Schmidt et al. | |
| 2008/0266866 | A1 | 10/2008 | Tsai | |
| 2008/0315228 | A1 | 12/2008 | Krames et al. | |
| 2009/0072252 | A1 | 3/2009 | Son et al. | |
| 2009/0134421 | A1 | 5/2009 | Negley | |
| 2009/0154166 | A1 | 6/2009 | Zhang et al. | |
| 2009/0161356 | A1 | 6/2009 | Negley et al. | |
| 2009/0175043 | A1 | 7/2009 | Frick | |
| 2009/0195186 | A1 | 8/2009 | Guest et al. | |
| 2009/0231895 | A1 | 9/2009 | Hu | |
| 2009/0237940 | A1 | 9/2009 | Wu et al. | |
| 2009/0244899 | A1 | 10/2009 | Chyn | |
| 2009/0303738 | A1 * | 12/2009 | Suss et al. | 362/488 |
| 2009/0303762 | A1 | 12/2009 | Jang et al. | |
| 2010/0060130 | A1 | 3/2010 | Li | |
| 2010/0061076 | A1 | 3/2010 | Mandy et al. | |
| 2010/0066266 | A1 | 3/2010 | Huang et al. | |
| 2010/0091487 | A1 | 4/2010 | Shin | |
| 2010/0148145 | A1 | 6/2010 | Ishibashi et al. | |
| 2010/0207502 | A1 | 8/2010 | Cao et al. | |
| 2010/0207534 | A1 | 8/2010 | Dowling et al. | |
| 2010/0244648 | A1 | 9/2010 | Yoo | |
| 2010/0264799 | A1 | 10/2010 | Liu et al. | |
| 2010/0277068 | A1 | 11/2010 | Broitzman | |
| 2010/0290229 | A1 | 11/2010 | Meyer, Sr. et al. | |
| 2010/0320499 | A1 | 12/2010 | Catalano et al. | |
| 2011/0032708 | A1 | 2/2011 | Johnston et al. | |
| 2011/0056429 | A1 | 3/2011 | Raring et al. | |
| 2011/0074270 | A1 | 3/2011 | Van De Ven et al. | |
| 2011/0095686 | A1 | 4/2011 | Falicoff et al. | |
| 2011/0140586 | A1 | 6/2011 | Wang | |
| 2011/0169406 | A1 | 7/2011 | Weekamp et al. | |
| 2011/0175510 | A1 | 7/2011 | Rains, Jr. et al. | |
| 2011/0175528 | A1 | 7/2011 | Rains, Jr. et al. | |
| 2011/0182065 | A1 | 7/2011 | Negley et al. | |
| 2011/0198979 | A1 | 8/2011 | Shum et al. | |
| 2011/0204763 | A1 | 8/2011 | Shum et al. | |
| 2011/0204779 | A1 | 8/2011 | Shum et al. | |
| 2011/0204780 | A1 | 8/2011 | Shum et al. | |
| 2011/0215699 | A1 | 9/2011 | Le et al. | |
| 2011/0242823 | A1 | 10/2011 | Tracy et al. | |
| 2011/0298371 | A1 | 12/2011 | Brandes et al. | |
| 2011/0309734 | A1 | 12/2011 | Lin et al. | |
| 2012/0018754 | A1 | 1/2012 | Lowes | |
| 2012/0043552 | A1 | 2/2012 | David et al. | |
| 2012/0043913 | A1 | 2/2012 | Melanson | |
| 2012/0161626 | A1 | 6/2012 | van de Ven et al. | |
| 2012/0187830 | A1 | 7/2012 | Shum et al. | |
| 2012/0212960 | A1 | 8/2012 | Rodriguez | |
| 2012/0293062 | A1 | 11/2012 | Pickard | |
| 2012/0314403 | A1 * | 12/2012 | Kennedy et al. | 362/109 |
| 2012/0319148 | A1 | 12/2012 | Donofrio et al. | |
| 2012/0320579 | A1 * | 12/2012 | Ferguson et al. | 362/235 |
| 2013/0058099 | A1 | 3/2013 | Shum et al. | |
| 2013/0322089 | A1 | 12/2013 | Martis et al. | |
| 2014/0028214 | A1 | 1/2014 | Mazumdar et al. | |
| 2014/0091697 | A1 | 4/2014 | Shum | |
| 2014/0146545 | A1 | 5/2014 | Shum et al. | |
| 2014/0313749 | A1 | 10/2014 | Shum et al. | |

FOREIGN PATENT DOCUMENTS

| | | |
|---|---|---|
| CN | 101608746 | 8/2011 |
| CN | 102149960 | 8/2011 |
| CN | 203099372 U | 7/2013 |
| JP | 02-028541 A | 1/1990 |
| JP | 2000-517465 | 12/2000 |
| JP | 2005-302483 | 10/2009 |
| JP | 2011-501351 | 1/2011 |
| WO | WO 2009/048956 | 3/2009 |
| WO | WO 2009/149263 | 12/2009 |

(56) References Cited

FOREIGN PATENT DOCUMENTS

| | | |
|---|---|---|
| WO | WO 2009/156969 | 12/2009 |
| WO | WO 2011/054716 | 5/2011 |

OTHER PUBLICATIONS

Communication from the Japanese Patent Office re 2012191931, dated Oct. 11, 2013, 4 pages.
USPTO Notice of Allowance for U.S. Appl. No. 13/025,833 dated Oct. 11, 2013 (11 pages).
USPTO Office Action for U.S. Appl. No. 13/269,193 dated Oct. 3, 2013 (12 pages).
USPTO Office Action for U.S. Appl. No. 13/480,767 dated Oct. 25, 2013 (28 pages).
USPTO Office Action for U.S. Appl. No. 13/535,142 dated Nov. 14, 2013 (23 pages).
USPTO Office Action for U.S. Appl. No. 13/959,422 dated Oct. 8, 2013 (10 pages).
Communication from the Japanese Patent Office re 2013532993 dated Jul. 9, 2014 (5 pages).
USPTO Notice of Allowance for U.S. Appl. No. 13/959,422 dated Jul. 9, 2014 (7 pages).
Thermal Properties of Plastic Materials', Professional Plastics, Aug. 21, 2010, p. 1-4.
USPTO Notice of Allowance for U.S. Appl. No. 13/269,193 dated Mar. 31, 2014 (8 pages).
USPTO Office Action for U.S. Appl. No. 13/274,489 dated Mar. 27, 2014 (14 pages).
USPTO Office Action for U.S. Appl. No. 13/480,767 dated Apr. 29, 2014 (21 pages).
Communication from the Chinese Patent Office re 201210322687.1 dated Mar. 3, 2014, 8 pages.
USPTO Office Action for U.S. Appl. No. 13/535,142 dated Feb. 25, 2014, 23 pages.
Haskell et al., 'Defect Reduction in (1100) m-plane gallium nitride via lateral epitaxial overgrowth by hydride vapor phase epitaxy', Applied Physics Letters 86, 111917 (2005), pp. 1-3.
International Preliminary Report & Written Opinion of PCT Application No. PCT/US2011/060030 dated Mar. 21, 2012, 11 pgs. total.
CFL Ballast IC Drive LED, www.placardshop.com, Blog, May 22, 2012, 3 pgs.
Rausch, 'Use a CFL ballast to drive LEDs', EDN Network, 2007, pp. 1-2.
USPTO Office Action for U.S. Appl. No. 12/785,953 dated Apr. 12, 2012, 12 pages.
USPTO Office Action for U.S. Appl. No. 12/785,953 dated Jan. 11, 2013, 15 pages.
USPTO Office Action for U.S. Appl. No. 13/025,791 dated Nov. 25, 2011, 12 pages.
USPTO Office Action for U.S. Appl. No. 13/025,791 dated Feb. 20, 2013, 14 pages.
USPTO Notice of Allowance for U.S. Appl. No. 13/025,791 dated Jun. 17, 2013, 8 pages.
USPTO Office Action for U.S. Appl. No. 13/025,833 dated Dec. 14, 2011, 11 pages.
USPTO Office Action for U.S. Appl. No. 13/025,833 dated Jul. 12, 2012, 16 pages.
USPTO Office Action for U.S. Appl. No. 13/025,833 dated Apr. 26, 2013, 23 pages.
USPTO Office Action for U.S. Appl. No. 13/025,849 dated Mar. 15, 2013, 18 pages.
USPTO Notice of Allowance for U.S. Appl. No. 13/025,849 dated Sep. 16, 2013, 10 pages.
USPTO Office Action for U.S. Appl. No. 13/025,860 dated Dec. 30, 2011, 15 pages.
USPTO Notice of Allowance for U.S. Appl. No. 13/025,860 dated Jun. 8, 2012, 10 pages.
USPTO Office Action for U.S. Appl. No. 13/274,489 dated Sep. 6, 2013, 13 pages.
USPTO Office Action for U.S. Appl. No. 13/535,142 dated Aug. 1, 2013, 14 pages.
USPTO Notice of Allowance for U.S. Appl. No. 29/399,523 dated Mar. 5, 2012, 8 pages.
USPTO Notice of Allowance for U.S. Appl. No. 29/399,524 dated Mar. 2, 2012, 9 pages.
USPTO Notice of Allowance for U.S. Appl. No. 29/423,725 dated Jul. 19, 2013, 11 pages.
USPTO Notice of Allowance for U.S. Appl. No. 13/274,489 dated Sep. 30, 2014 (7 pages).
USPTO Office Action for U.S. Appl. No. 13/535,142 dated Sep. 22, 2014 (25 pages).
USPTO Notice of Allowance for U.S. Appl. No. 13/856,613 dated Nov. 21, 2014 (8 pages).
USPTO Notice of Allowance for U.S. Appl. No. 13/909,752 dated Sep. 30, 2014 (9 pages).
USPTO Office Action for U.S. Appl. No. 14/0.54,597 dated Dec. 5, 2014 (9 pages).
USPTO Office Action for U.S. Appl. No. 14/075,936 dated Sep. 24, 2014 (7 pages).
USPTO Office Action for U.S. Appl. No. 14/097,043 dated Oct. 15, 2014 (11 pages).
USPTO Office Action for U.S. Appl. No. 14/211,606 dated Nov. 28, 2014 (18 pages).

* cited by examiner

13A00

13B00

1400

2200

ACCESSORIES FOR LED LAMPS

The present application claims priority to German Application 102012017225.9 filed on Aug. 30, 2012, which claims priority to U.S. application Ser. No. 13/480,767 filed on May 25, 2012, which claims priority to U.S. Provisional Application No. 61/530,832, filed on Sep. 2, 2011; and German Application No. 102012017225.9 claims priority to U.S. Provisional Application No. 61/655,894 filed on Jun. 5, 2012; and this application is a continuation-in-part of U.S. application Ser. No. 13/915,432, filed on Jun. 11, 2013, which claims priority to U.S. Provisional Application No. 61/659,386, filed on Jun. 13, 2012, each of which is incorporated herein by reference in its entirety.

FIELD

The disclosure relates to the field of LED illumination and more particularly to techniques for improved accessories for LED lamps.

BACKGROUND

Accessories for standard halogen lamps such as MR16 lamps include, for example, lenses, diffusers, color filters, polarizers, linear dispersion, accessories, collimators, projection frames, louvers and baffles. Such accessories are commercially available from companies such as Abrisa, Rosco, and Lee Filters. These accessories can be used to control the quality of light from the lamps including elimination of glare, to change the color temperature of the lamp, or to tailor a beam profile for a particular application.

Generally, accessories for certain lamps (e.g., halogen lamps) are required to withstand high temperatures. Often, such halogen lamp accessories require disassembly of the lamp from the luminaire to incorporate the accessory. This set of disadvantages results in the accessories having high costs and being cumbersome, and/or expensive and/or complicated to install.

There is a need for improved approaches for attaching field-installable accessories to lamps.

SUMMARY

This disclosure relates to an apparatus allowing for simple and low cost implementation of accessories for LED lamps that can be used to retrofit existing luminaires.

In a first aspect, apparatus are disclosed comprising an LED lamp; a lens, mechanically affixed to the LED lamp; a first fixture mechanically attached to the lens; a first accessory having a second fixture, wherein the first accessory is mated in proximity to the lens using the first fixture and the second fixture; and wherein the first fixture and the second fixture are configured to produce a retaining force between the first accessory and the lens.

In a second aspect, methods of providing and assembling LED lamp accessories are provided.

BRIEF DESCRIPTION OF THE DRAWINGS

Those skilled in the art will understand that the drawings, described herein, are for illustration purposes only. The drawings are not intended to limit the scope of the present disclosure.

DETAILED DESCRIPTION

"Accessory" or "Accessories" includes any mechanical, optical or electro-mechanical component or electrical component to be mated to an LED lamp. In certain embodiments, an accessory comprises an optically transmissive film, sheet, collimator, frame, plate, or combination of any of the foregoing. In certain embodiments, an accessory includes a mechanical fixture to retain the accessory in its mated position. In certain embodiments, an accessory is magnetically retained in place.

Reference is now made in detail to certain embodiments. The disclosed embodiments are not intended to be limiting of the claims.

In certain embodiments, an LED Lamp comprises a lens having a center and a diameter; a first magnet attached to the center of the lens; a first accessory disposed on the lens; and a second magnet attached to the center of the first accessory; wherein the first magnet and the second magnet are configured to retain the first accessory against the lens. In a further embodiment, the magnet is configured such that the magnetic force between the first magnet and the second magnet enable the self-centering of the accessory on to the lamp.

Figure 1A:
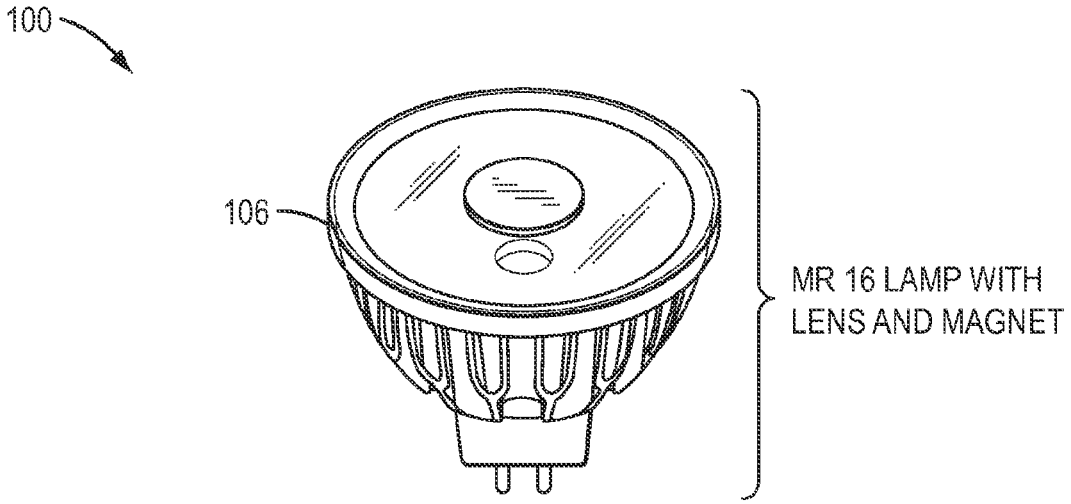
FIG. 1A depicts an assembled LED lamp with an accessory, according to certain embodiments.

FIG. 1A depicts an assembly 100 of an LED lamp of an embodiment having improved accessories for LED Lamps. As shown in FIG. 1A the MR16 lamp with lens 106 comprises an LED lamp with an installed accessory.

Figure 1B:
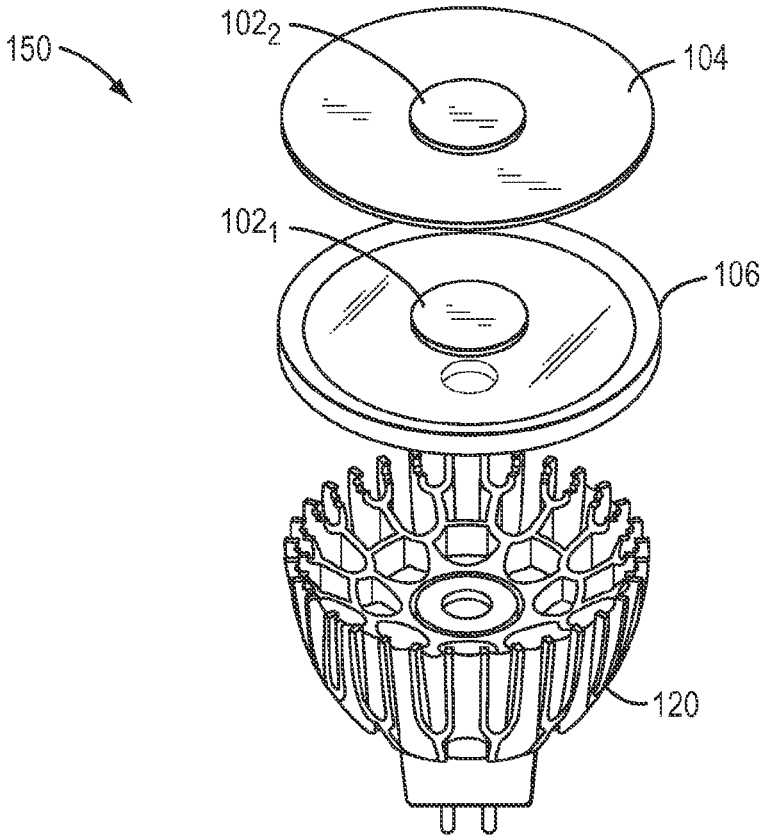
FIG. 1B shows an exploded view of an LED lamp with accessories according to certain embodiments.

FIG. 1B shows an exploded view of an LED lamp 150 with an accessory in a system having improved accessories for LED lamps.

FIG. 1B shows an example of an LED lamp 150 having an MR16 form factor including a heat sink 120. A lens 106 is attached to the heat sink 102 or other part of the lamp. In certain embodiments, the lens 106 comprises a folded total internal reflection lens. A first magnet (e.g., magnet $\mathbf{102}_1$) is attached to the center of the lens 106. An accessory 104 (e.g., a plastic accessory) having a second magnet (e.g., magnet $\mathbf{102}_2$) attached to the center can be disposed over the lens 106 and the opposing magnets (e.g., magnet $\mathbf{102}_1$, magnet $\mathbf{102}_2$) can hold the accessory 104 to the lens 106. The first and second opposing magnets can be configured to retain the accessory against the lens. For example, the opposing magnets may have an opposite polarity. The accessory 104 may have substantially the same diameter as the lens, and in certain embodiments covers an optical region of the lens, such as for example greater than 90% of the optical aperture of the LED lamp. For example, in certain embodiments, the diameter of the accessory is from about 99% to 101% of the diameter of the lens; from about 95% to 105% the diameter of the lens, and in certain embodiments from about 90% to about 110% the diameter of the lens. In certain embodiments, the accessory comprises a transparent film such as, for example, a plastic film. In other embodiment, the accessories may be a plate made of light transmissive material including plastic or glass. In certain embodiments, the accessory is selected from a diffuser, a color filter, a polarizer, a linear dispersion element, a projector, a louver, a baffle, and/or any combination of any of the foregoing. In certain embodiments, the first magnet and the first accessory have a combined thickness of less than about 5 mm, less than about 3 mm, less than about 1 mm, less than about 0.5 mm, and in certain embodiments, less than about 0.25 mm.

In some embodiments, a metallic member (e.g., using iron, nickel, cobalt, certain steels and/or other alloys, and/or other rigid or semi-rigid materials) may replace one of the magnets, and may serve to accept a mechanically mated accessory. Any one or more known-in-the-art techniques can be applied to the design of the lens 106 (and/or lens sub-assembly) so as to accommodate a mechanically mated accessory. For example, the aforementioned mechanical mating techniques may comprise a mechanical fixture such as a ring clip member, a bayonet member, a screw-in ring member, a leaf spring member, a hinge, or a combination of any of the foregoing. Any of the mating techniques disclosed herein can further serve to center the accessory upon installation and/or during use.

Figure 2:
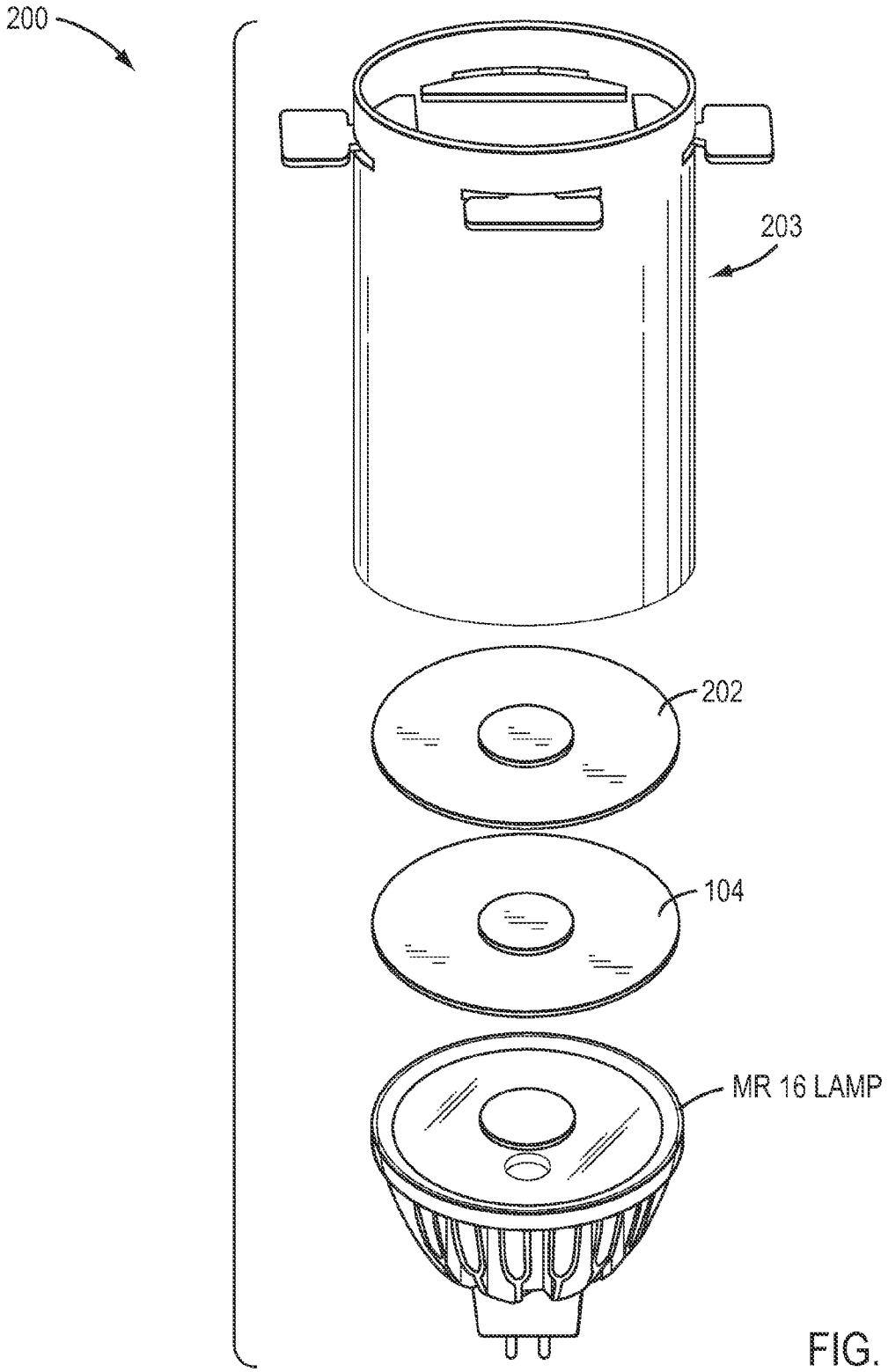
FIG. 2 shows an exploded view of an LED lamp with multiple accessories, according to certain embodiments.

FIG. 2 shows an exploded view 200 of an LED lamp with multiple accessories in a system having improved accessories for LED lamps.

In certain embodiments as shown in FIG. 2, an LED lamp comprises a second accessory 202 disposed adjacent to a first accessory 104. In certain embodiments, a second magnet is attached to the center of the second accessory and is used to affix the second accessory to the lamp.

In certain embodiments, a third accessory 203 can be attached. For example, a third accessory can be a projection frame (as shown), a collimator (see FIG. 8A), or other accessory or combination of accessories.

A collimator is a tube with walls that attenuate light, or are opaque (e.g., do not transmit light). The purpose of the collimator is to block or "cut off" or reduce the projection of high angle light coming from the lamp. The collimator can be formed of a tube with openings such as, for example, one opening at each end of the tube. At the end near the lamp, light enters the tube and the low angle light exits the tube at the other end of the collimator opening whereas high angle light is absorbed by and/or is extracted by the collimator walls. The length of the collimator can be determined, at least in part, the amount of high angle light emitted by the lamp.

A projection frame is similar to a collimator with the addition of a set of light frame features such as, for example, shatters, baffles, and/or louvers, positioned at the output of end of the collimator. The light frame features are positioned a distance away from the lens, and as such, features formed by the shape of the frame can be projected on the wall. The frame for example may comprise a set of baffles that block, direct, and/or reflect at least part of the light to form any arbitrary set of patterns, for example, rectangular, square, oval, and/or triangular patters of the projected light from the lamp. In certain embodiments, the frame may have a silhouette image that is designed to be projected onto a surface such as a wall.

The term "LED lamp" can any include any type of LED illumination source including lamp types that emit directed light where the light distribution is generally directed within a single hemisphere. Such lamp types include, for example, lamps having form factors such as MR, PAR, BR, ER, or AR. Table 1 below lists a subset of specific designations of the aforementioned form factors.

TABLE 1

| Designation | Base Diameter (crest of thread) |
|---|---|
| MR11 | 35 mm |
| MR13-1/4 | 42 mm |
| MR16 | 51 mm |
| PAR16 | 50 mm |
| PAR20 | 65 mm |
| PAR30 | 95 mm |
| PAR36 | 115 mm |
| PAR38 | 120 mm |
| PAR46 | 145 mm |
| PAR56 | 175 mm |
| PAR64 | 200 mm |

Also, some embodiments of an LED lamp are in the form of directional lamps of various designations, as given in Table 2:

TABLE 2

| Designation | Name/Characteristic |
|---|---|
| R | Reflector: "Reflector "type designated an R . . . with multiple bulb diameters. |
| RBL | Reflector Bulged, Lens end |
| RD | Reflector Dimpled |
| RB | Reflector Bulged |
| RE | Reflector Elliptical |

Still further, there are many configurations for the base of LED lamps beyond the depicted GU5.3 MR16 lamp (e.g., see FIG. 3A) that may be used with embodiments provided by the present disclosure. For example Table 3 gives standards (see "Designation") and corresponding characteristics of the base of the lamp.

TABLE 3

| Designation | Base Diameter (crest of thread) | Name/Characteristic | IEC 60061-1 Standard Sheet |
|---|---|---|---|
| | 5 mm | Lilliput Edison Screw (LES) | 7004-25 |
| E10 | 10 mm | Miniature Edison Screw (MES) | 7004-22 |
| E11 | 11 mm | Mini-Candelabra Edison Screw (mini-can) | (7004-6-1) |
| E12 | 12 mm | Candelabra Edison Screw (CES) | 7004-28 |
| E14 | 14 mm | Small Edison Screw (SES) | 7004-23 |
| E17 | 17 mm | Intermediate Edison Screw (IES) | 7004-26 |
| E26 | 26 mm | [Medium] (one-inch) Edison Screw (ES or MES) | 7004-21A-2 |
| E27 | 27 mm | [Medium] Edison Screw (ES) | 7004-21 |
| E29 | 29 mm | [Admedium] Edison Screw (ES) | |
| E39 | 39 mm | Single-contact (Mogul) Giant Edison Screw (GES) | 7004-24-A1 |
| E40 | 40 mm | (Mogul) Giant Edison Screw (GES) | 7004-24 |

Additionally, there are many G-type lamps as given in the following List 1:

List 1: G4, GU4, GY4, GZ4, G5, G5.3, G5.3-4.8, GU5.3, GX5.3, GY5.3, G6.35, GX6.35, GY6.35, GZ6.35, G8, GY8.6, G9, G9.5, GU10, G12, G13, G23, GU24, G38, GX53.

In certain lamps such as an ER lamp, the lens is referred to as a shield. Thus, in certain embodiments a lens includes shields, which do not substantially serve to divert light.

Accessories and methods of attached accessories disclosed herein may be used with any suitable LED lamp configuration such as, for example, any of those disclosed in Table 1, and/or those configurations disclosed in Table 2, and/or those configurations disclosed in Table 3 and/or those configurations disclosed in List 1.

While FIG. 1 and FIG. 2 describe accessories attached at the central axis of the lamp/lens, the accessories can also be attached, mechanically or magnetically, at other locations provided that sufficient light output is still obtained. For example, the attachment point may be made near the perimeter of the lens or at the perimeter of the lamp form factor envelope. Various embodiments wherein the accessories are mechanically or magnetically attached at other locations are disclosed herein.

Figure 3A:
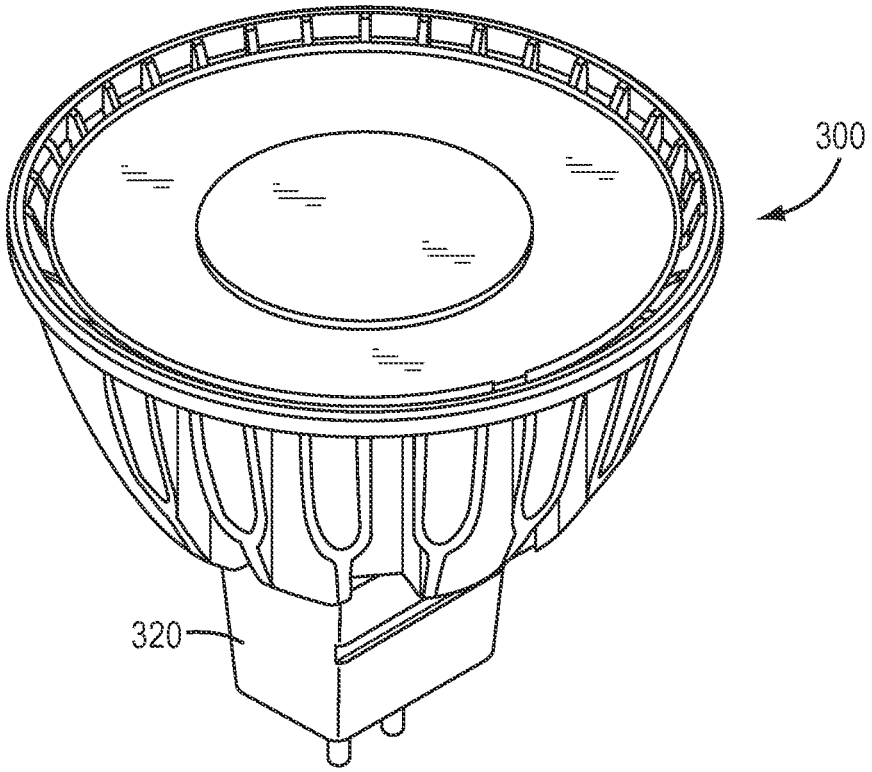
FIG. 3A and FIG. 3B illustrate various embodiments provided by the present disclosure.
Figure 3B:
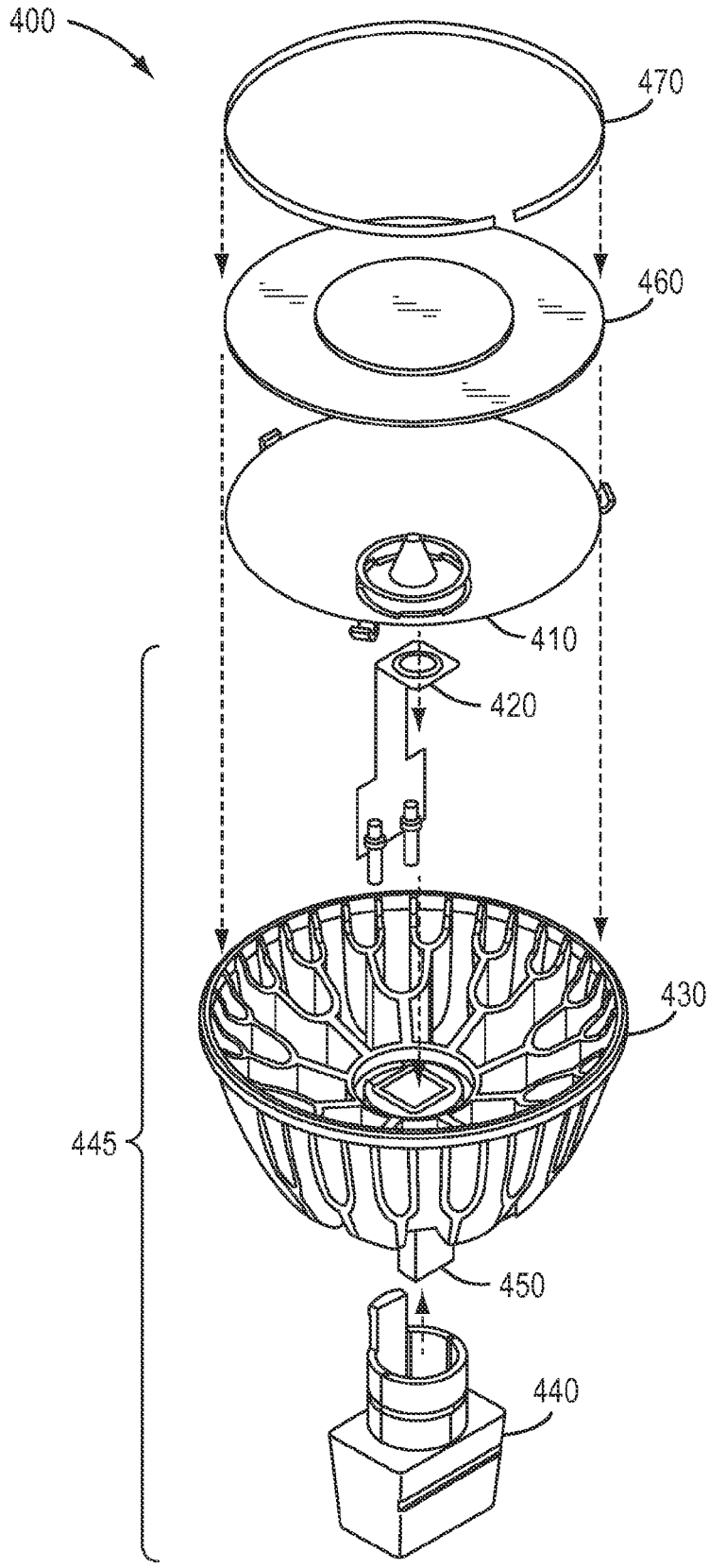

FIG. 3A illustrates an embodiment of the present disclosure. More specifically, FIG. 3A and FIG. 3B illustrate embodiments of MR16 form factor-compatible LED lighting source 300 having a GU 5.3 form factor-compatible base 320. GU 5.3 MR16 lighting sources typically operate at 12 volts, alternating current (e.g., VAC). In the examples illustrated, LED lighting source 300 is configured to provide a spot beam angle less than 15 degrees. In other embodiments, LED lighting sources may be configured to provide a flood light having a beam angle greater than 15 degrees. In certain embodiments, an LED assembly may be used within LED lighting source 300. Advanced LED assemblies are currently under development by the assignee of the present patent application. In various embodiments, LED lighting source 300 may provide a peak output of greater than about 1,000 candelas (or greater than 100 lumens). For certain high output applications, the center beam candle power may be greater than 10,000 candela or 100,000 candela with associated light levels greater than 1000 lumens or 5000 lumens. Various embodiments of the present disclosure achieve the same or higher brightness than conventional halogen bulb MR16 lights.

FIG. 3B illustrates a modular diagram according to various embodiments of the present disclosure. As can be seen in FIG. 3B, in various embodiments, LED lighting source 400 includes a lens 410, a light source in the form of an LED module/assembly 420, a heat sink 430, a base module 440, a mechanically-retained accessory 460, and a retainer 470. As will be discussed further below, in various embodiments, the modular approach to assembling a lighting source 400 can reduce the manufacturing complexity, reduce manufacturing costs, and increase the reliability of such lighting sources.

In various embodiments, lens 410 and mechanically-retained accessory 460 may be formed from transparent material, such as glass, polycarbonate, acrylic, COC material, or other material. In certain embodiments, the lens 410, may be configured in a folded path configuration to generate a narrow output beam angle. Such a folded optic lens enables embodiments of lighting source 400 to have a tighter columniation of output light than is normally available from a conventional reflector of equivalent depth. The mechanically-retained accessory 460 may perform any of the function or functions as previously described for accessories.

In FIG. 3B, lens 410 may be secured to heat sink 430 by means of one or more clips integrally formed on the edge of reflecting lens 410. In addition, reflecting lens 410 may also be secured using an adhesive compound disposed proximate to where integrated LED assembly 420 is secured to heat sink 430. In various embodiments, separate clips may be used to restrain reflecting lens 410. These clips may be formed, for example, of heat resistant plastic material that may be white colored to reflect backward scattered light back through the lens.

In other embodiments, lens 410 may be secured to heat sink 430 using the clips described above. Alternatively, lens 410 may be secured to one or more indents of heat sink 430, as will be illustrated below in greater detail. In some embodiments, once lens 410 is secured to heat sink 430, the attachments are not intended to be removed by hand. In some cases, one or more tools are to be used to separate these components without damage.

The embodiments of FIG. 3A and FIG. 3B are merely illustrative embodiments. The particulars of the basic LED lamp components 445 can vary from one LED lamp to another, and the configuration or selection of any one or more particular members of the basic LED lamp components 445 may result in an assembly having certain characteristic, such as efficiency, brightness, color, thermal properties, and/or others.

In certain embodiments, as will be discussed below, integrated LED assemblies and modules may include multiple LEDs such as for example thirty-six (36) LEDs arranged in series, in parallel series (e.g., three parallel strings of twelve (12) LEDs in series), or other configurations. In certain embodiments, any number of LEDs may be used such as, for example, 1, 10, 16, or more. In certain embodiments, the LEDs may be electrically coupled serially or in any other appropriate configuration.

In certain embodiments, the targeted power consumption for LED assemblies is less than 13 watts. This is much less than the typical power consumption of halogen-based MR16 lights (50 watts). Accordingly, embodiments of the present disclosure are capable of matching the brightness or intensity of halogen-based MR16 lights, but using less than 20% of the energy. In certain embodiments, the LED assemblies may be configured for higher power operation such as greater than 13 W and incorporated into higher-output lamp form factors such as PAR30, PAR38, and other lamp form factors. In certain applications, an LED assembly can be incorporated into a luminaire and the lens assembly can accommodate accessorizing according to the embodiments provided by the present disclosure, which is not limited to retrofit lamps.

In various embodiments of the present disclosure, LED assembly 420 is directly secured to heat sink 430 to dissipate heat from the light output portion and/or the electrical driving circuits. In some embodiments, heat sink 430 may include a protrusion portion 450 to be coupled to electrical driving circuits. As will be discussed below, LED assembly 420 typically includes a flat substrate such as silicon or the like. In various embodiments, it is contemplated that an operating temperature of LED assembly 420 may be on the order of 125° C. to 140° C. The silicon substrate is then secured to the heat sink using a high thermal conductivity epoxy (e.g., thermal conductivity ~96 W/mk.). In some embodiments, a thermoplastic/thermoset epoxy may be used such as TS-369, TS-3332-LD, or the like, available from Tanaka Kikinzoku Kogyo K.K. Other epoxies may also be used. In some embodiments, no screws are used to secure the LED assembly to the heat sink, however, screws or other fastening means may be used in other embodiments.

In certain embodiments, heat sink 430 may be formed from a material having a low thermal resistance/high thermal conductivity. In some embodiments, heat sink 430 may be formed from an anodized 6061-T6 aluminum alloy having a thermal conductivity k=167 W/m.k., and a thermal emissivity e=0.7. In other embodiments, other materials may be used such as 6063-T6 or 1050 aluminum alloy having a thermal conductivity k=225 W/mk. and a thermal emissivity e=0.9. In other embodiments, still other alloys such AL 1100, or the like may be used. In still other embodiments, a die cast alloy with thermal conductivity as low as 96 W/mK is used. Additional coatings may also be added to increase thermal emissivity, for example, paint provided by ZYP Coatings, Inc., which incorporate $CR_2O_3$ or $CeO_2$ may provide a thermal emissivity e=0.9; coatings provided by Materials Technologies Corporation under the tradename Duracon™ may provide a thermal emissivity e>0.98; and the like. In other embodiments, heat sink 430 may include other metals such as copper, or the like.

In some examples, at an ambient temperature of 50° C., and in free natural convection, the heat sink 430 has been measured to have a thermal resistance of approximately 8.5° C./Watt, and heat sink 430 has been measured to have a thermal resistance of approximately 7.5° C./Watt. With further development and testing, it is believed that a thermal resistance of as little as 6.6° C./Watt may be achieved. In view of the present patent disclosure, one of ordinary skill in the art will be able to envision other materials having different thermal properties consistent embodiments of the present disclosure.

In certain embodiments, base module 440 in FIG. 3B provides a standard GU 5.3 physical and electronic interface to a light socket. As will be described in greater detail below, a cavity within base module 440 includes high temperature resistant electronic circuitry used to drive LED assembly 420. In ° C. embodiments, an input voltage of 12 VAC to the lamps are converted to 120 VAC, 40 VAC, or other voltage by the LED driving circuitry. The driving voltage may be set depending upon specific LED configuration (e.g., series, parallel/series, etc.) desired. In various embodiments, protrusion portion 450 extends within the cavity of base module 440.

The shell of base module 440 may be formed from an aluminum alloy or a zinc alloy, and/or may be formed from an alloy similar to that used for heat sink 430 and/or heat sink 430. In one example, an alloy such as AL 1100 may be used. In other embodiments, high temperature plastic material may be used. In some embodiments, instead of being separate units, base module 440 may be monolithically formed with heat sink 430.

As illustrated in FIG. 3B, a portion of the LED assembly 420 (silicon substrate of the LED device) contacts the heat sink 430 in a recess within the heat sink 430. Additionally, another portion of the LED assembly 420 (containing the LED driving circuitry) is bent downwards and is inserted into an internal cavity of base module 440.

In certain embodiments, to facilitate a transfer of heat from the LED driving circuitry to the shell of the base assemblies, and of heat from the silicon substrate of the LED device, a potting compound may be provided. The potting compound may be applied in a single step to the internal cavity of base module 440 and/or to the recess within heat sink 430. In certain embodiments, a compliant potting compound such as Omegabond® 200 available from Omega Engineering, Inc. or 50-1225 from Epoxies, Etc., may be used. In other embodiments, other types of heat transfer materials may be used.

Figure 4A:
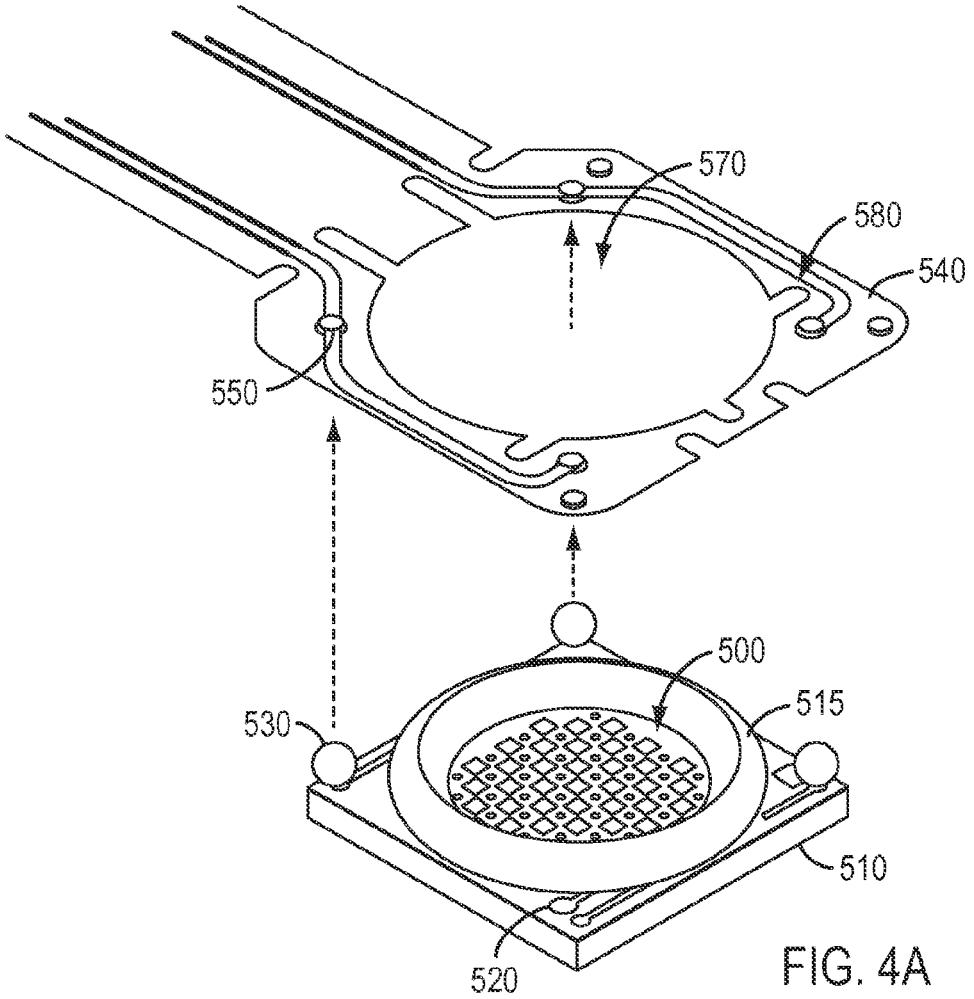
FIG. 4A and FIG. 4B illustrate modular diagrams according to certain embodiments of the present disclosure.
Figure 4B:
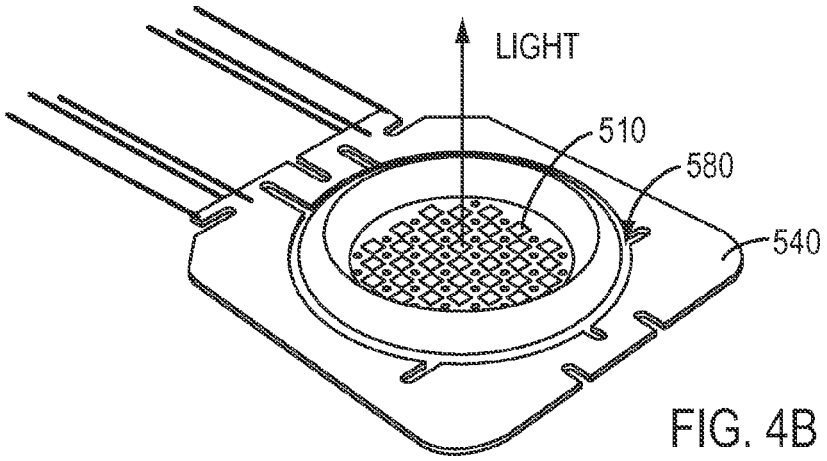

FIG. 4A and FIG. 4B illustrate an embodiment of the present disclosure. More specifically, FIG. 4A illustrates an LED package subassembly (LED module) according to certain embodiments. More specifically, a plurality of LEDs 500 is illustrated as being disposed upon a substrate 510. In some embodiments, the plurality of LEDs 500 may be connected in series and powered by a voltage source of approximately 120 volts AC (VAC). To enable a sufficient voltage drop (e.g., 3 to 4 volts) across each LED 500, in various embodiments 30 to 40 LEDs may be used. In certain embodiments, 27 to 39 LEDs may be coupled in series. In other embodiments, LEDs 500 are connected in parallel series and powered by a voltage source of approximately 40 VAC. For example, the plurality of LEDs 500 include 36 LEDs may be arranged in three groups each having 12 LEDs 500 coupled in series. Each group is thus coupled in parallel to the voltage source (40 VAC) provided by the LED driver circuitry such that a sufficient voltage drop (e.g., 3 to 4 volts) is achieved across each LED 500. In other embodiments, other driving voltages may be used, and other arrangements of LEDs 500 may also be employed.

In certain embodiments, the LEDs 500 are mounted upon a silicon substrate 510, or other thermally conductive substrate. In certain embodiments, a thin electrically insulating layer and/or a reflective layer may separate LEDs 500 and the silicon substrate 510. Heat produced from LEDs 500 may be transferred to silicon substrate 510 and/or to a heat sink by means of a thermally conductive epoxy, as discussed herein.

In certain embodiments, the silicon substrate is approximately 5.7 mm×5.7 mm in size, and approximately 0.6 mm in depth, or the silicon substrate is approximately 8.5 mm×8 mm in size, and approximately 0.6 mm in depth. The dimensions may vary according to specific lighting requirements. For example, for lower brightness intensity, fewer LEDs may be mounted upon the substrate and accordingly the substrate may decrease in size. In other embodiments, other substrate materials may be used and other shapes and sizes may also be used.

As shown in FIG. 4A, a ring of silicone (e.g., silicon dam 515) is disposed around LEDs 500 to define a well-type structure. In certain embodiments, a phosphorus bearing material is disposed within the well structure. In operation, LEDs 500 provide a blue-emitting, a violet-emitting, or a UV-emitting light output. In turn, the phosphorous bearing material is excited by the output light, and emits white light output.

As illustrated in FIG. 4A, a number of bond pads 520 may be provided on substrate 510 (e.g., 2 to 4). Then, a conventional solder layer (e.g., 96.5% tin and 5.5% gold) may be disposed upon silicon substrate 510, such that one or more solder balls 530 are formed thereon. In the embodiments illustrated in FIG. 4A, four bond pads 520 are provided, one at each corner, two for each power supply connection. In other embodiments, only two bond pads may be used, one for each AC power supply connection.

FIG. 4A shows a flexible printed circuit (FPC) 540. In certain embodiments, FPC 540 may include a flexible substrate material such as a polyimide, such as Kapton™ from DuPont, or the like. As illustrated, FPC 540 may have a series of bonding pads 550, for bonding to silicon substrate 510, and bonding pads 550, for coupling to the high supply voltage (e.g., 120 VAC, 40 VAC, etc.). Additionally, in some embodiments, an opening 570 is provided, through which LEDs 500 will shine through.

Various shapes and sizes for FPC 540 may be used in the embodiments of the present disclosure. For example, as illustrated in FIG. 4A, a series of cuts 580 may be made upon FPC 540 to reduce the effects of expansion and contraction of FPC 540 with respect to substrate 510. As another example, a different number of bonding pads 550 may be provided, such as two bonding pads. As another example, FPC 540 may be crescent shaped, and opening 570 may not be a through hole. In other embodiments, other shapes and sizes for FPC 540 may be used consistent with present patent disclosure.

In combining FIG. 4A the elements illustrated in FIG. 4A to provide the assembly illustrated in FIG. 4B, substrate 510 is bonded to FPC 540 via solder balls 530, in a conventional flip-chip type arrangement to the top surface of the silicon. By making the electrical connection at the top surface of the silicon, the FPC is electrically isolated from the heat transfer surface of the silicon. This allows the entire bottom surface of the silicon substrate 510 to transfer heat to the heat sink. Additionally, this allows the LED to be bonded directly to the heat sink to maximize heat transfer instead of a printed circuit board material that typically inhibits heat transfer. As can be seen in this configuration, LEDs 500 are thus positioned to emit light through opening 570. In various embodiments, the potting compound discussed above may also be used as an under fill to seal the space (e.g., see cuts 580) between substrate 510 and FPC 540. After the electronic driving devices and the silicon substrate 510 are bonded to FPC 540, the LED package submodule or assembly 420 is thus constructed.

As an alternative, the LEDs 500 may be positioned to emit light into the cavity of the lamp, and the LEDs are powered by means of discrete conductors. In various embodiments, the LEDs may be tested for proper operation, and such testing can be done after the LED lamp is in a fully-assembled or in a partially-assembled state.

Figure 5A:
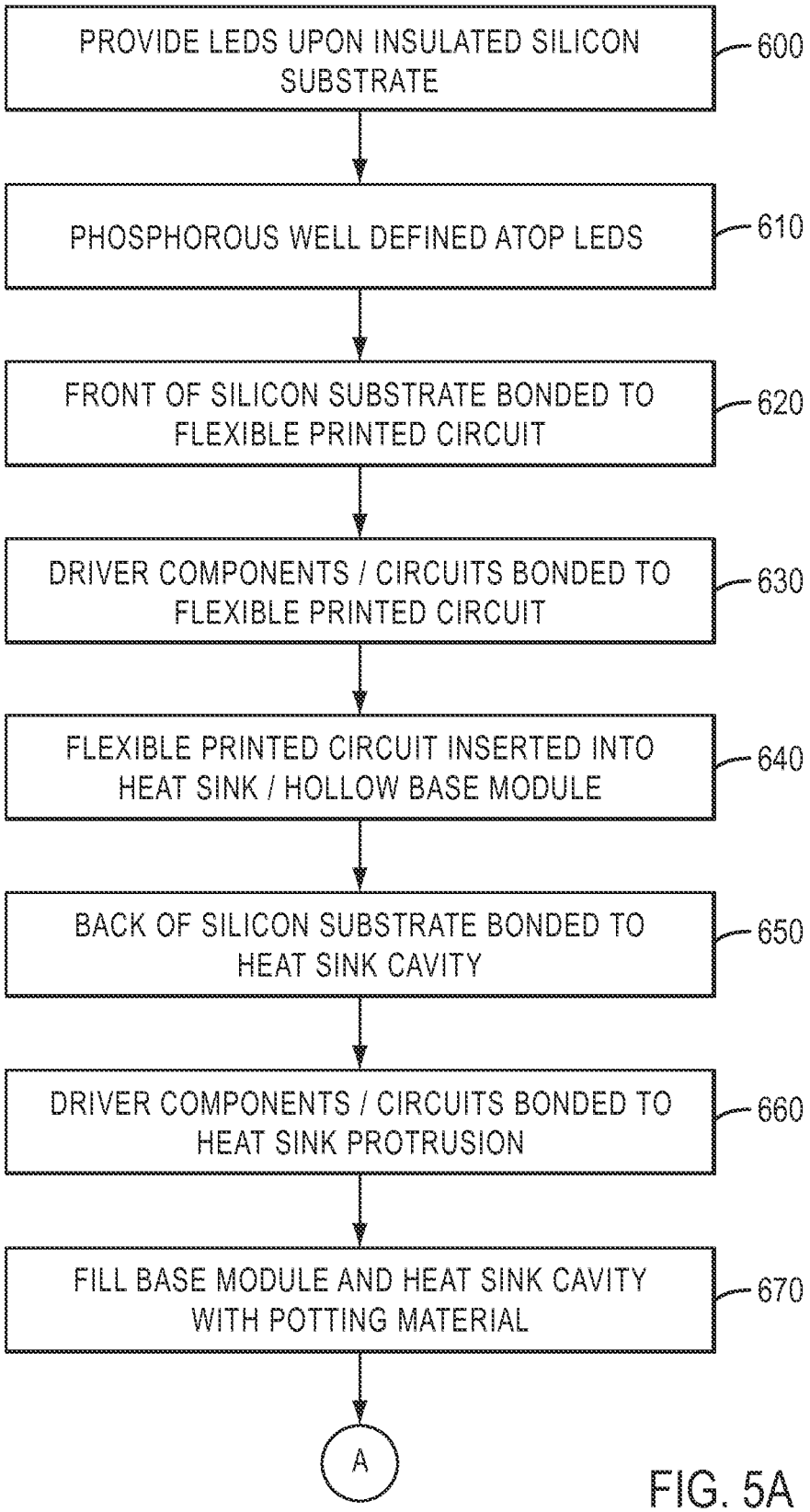
FIG. 5A and FIG. 5B illustrate flow diagrams of an assembly procedures provided by embodiments of the present disclosure.

FIG. 5A and FIG. 5-B illustrate a block diagram of a manufacturing process according to embodiments of the present disclosure. In certain embodiments, some of the manufacturing processes may occur in parallel or in series. For understanding, reference may be given to features in prior figures.

In certain embodiments, the following process may be performed to form an LED assembly/module. Initially, a plurality of LEDs 500 are provided upon an electrically insulated silicon substrate 510 and wired, step 600. As illustrated in FIG. 4A, a silicone dam 515 is placed upon the silicon substrate 510 to define a well, which is then filled with a phosphor-bearing material, step 610. Next, the silicon substrate 510 is bonded to a flexible printed circuit 540, step 620. As disclosed above, a solder ball and flip-chip soldering may be used for the soldering process in various embodiments.

Next, a plurality of electronic driving circuit devices and contacts may be soldered to the flexible printed circuit 540, step 630. The contacts are for receiving a driving voltage of approximately 12 VAC. As discussed above, unlike present state of the art MR16 light bulbs, the electronic circuit devices, in various embodiments, are capable of sustained high-temperature operation, (e.g., 120° C.).

In various embodiments, the second portion of the flexible printed circuit including the electronic driving circuit is inserted into the heat sink and into the inner cavity of the base module, step 640. As illustrated, the first portion of the flexible printed circuit is then bent approximately 90 degrees such that the silicon substrate is adjacent the recess of the heat sink. The back side of the silicon substrate is then bonded to the heat sink within the recess of the heat sink using an epoxy, or the like, step 650.

In various embodiments, one or more of the heat producing the electronic driving components/circuits may be bonded to the protrusion portion of the heat sink, step 660. In some embodiments, electronic driving components/circuits may have heat dissipating contacts (e.g., metal contacts) These metal contacts may be attached to the protrusion portion of the heat sink via screws (e.g., metal, nylon, or the like). In some embodiments, a thermal epoxy may be used to secure one or more electronic driving components to the heat sink. Subsequently a potting material is used to fill the air space within the base module and to serve as an under fill compound for the silicon substrate, step 670.

Subsequently, a reflective lens may be secured to the heat sink, step 680, and the LED light source may then be tested for proper operation, step 690.

In certain embodiments, the base sub-assembly/modules that operate properly may be packaged along with one or more optically transmissive member offerings and/or a retaining ring (described above), step 700, and shipped to one or more distributors, resellers, retailers, or customers, step 710. In certain embodiments, the modules and separate optically transmissive member offerings may be stocked, stored, or the like. A one or more optically transmissive member offerings may be one or more lenses.

Subsequently, in various embodiments, an end user desires a particular lighting solution, step 720. In certain examples, the lighting solution may require different beam angles, different cut-off angles or roll-offs, different coloring, different field angles, and the like. In various embodiments, the beam angles, the field angles, and the full cutoff angles may vary from the above, based upon engineering and/or marketing requirements. Additionally, the maximum intensities may also vary based upon engineering and/or marketing requirements.

Based upon the end-user's application, a secondary optically transmissive members may be selected, step 730. In various embodiments, the selected lens may or may not be part of a kit for the lighting module. In other words, in some examples, various optically transmissive members are provided with each lighting module; and in other examples, lighting modules are provided separately from the optically transmissive members.

In various embodiments, an assembly process may include attaching the retaining ring to one or more optically transmissive member, and snapping the retaining ring into a groove of the heat sink, step 740. In other embodiments, a retaining ring is already installed for each optically transmissive members that is provided.

In some embodiments, once the retaining ring is snapped into the heat sink, clips, or the like, the retaining ring (and secondary optic lens) cannot be removed by hand. In such cases, a tool, such as a thin screwdriver, pick, or the like, must be used to remove a secondary optic lens (optically transmissive members) from the assembled unit. In other embodiments, the restraint mechanism may be removed by hand.

Figure 5B:
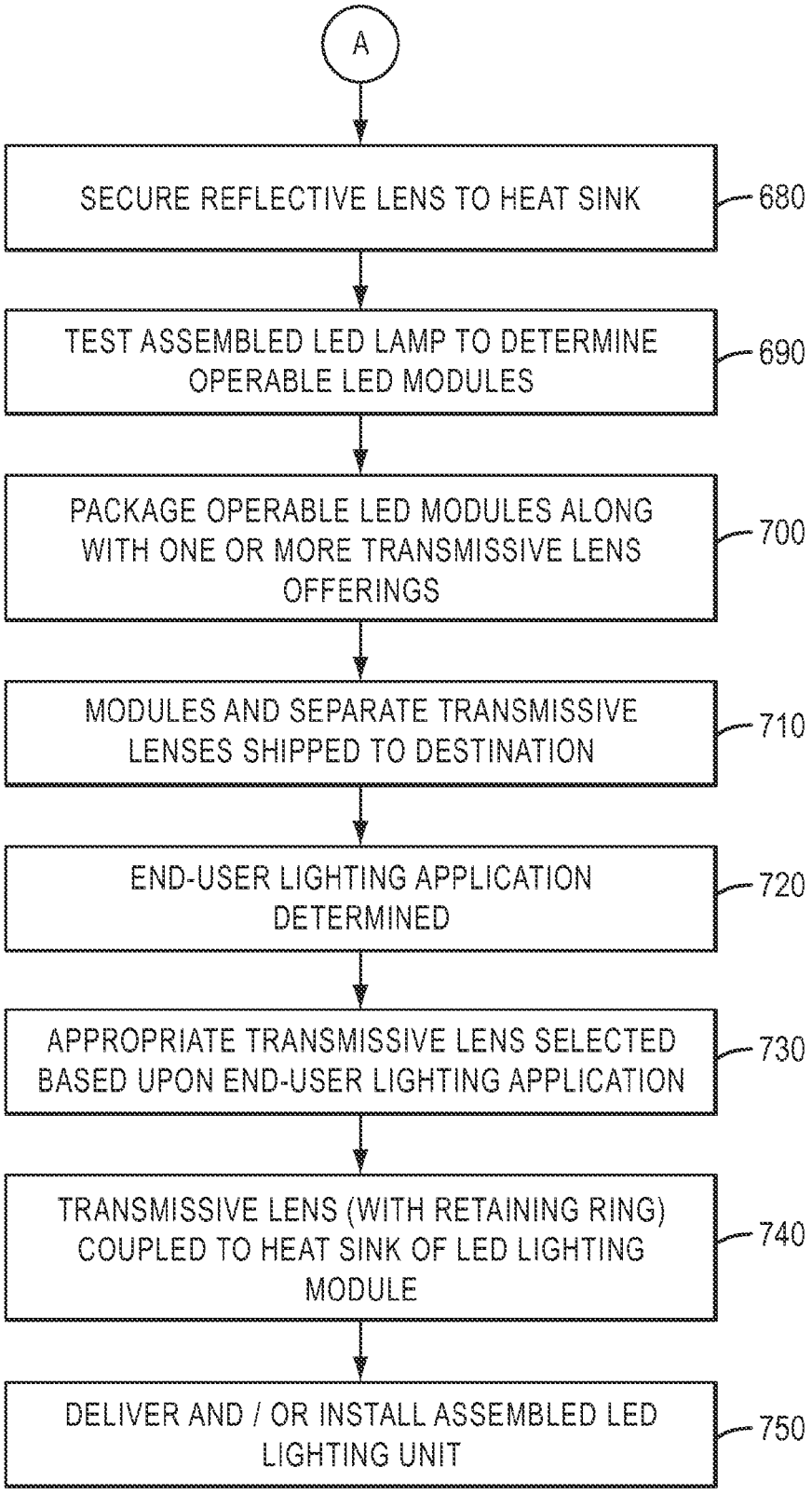

In FIG. 5B, the assembled lighting unit may be delivered to the end-user and installed, step 750.

Figure 6A:
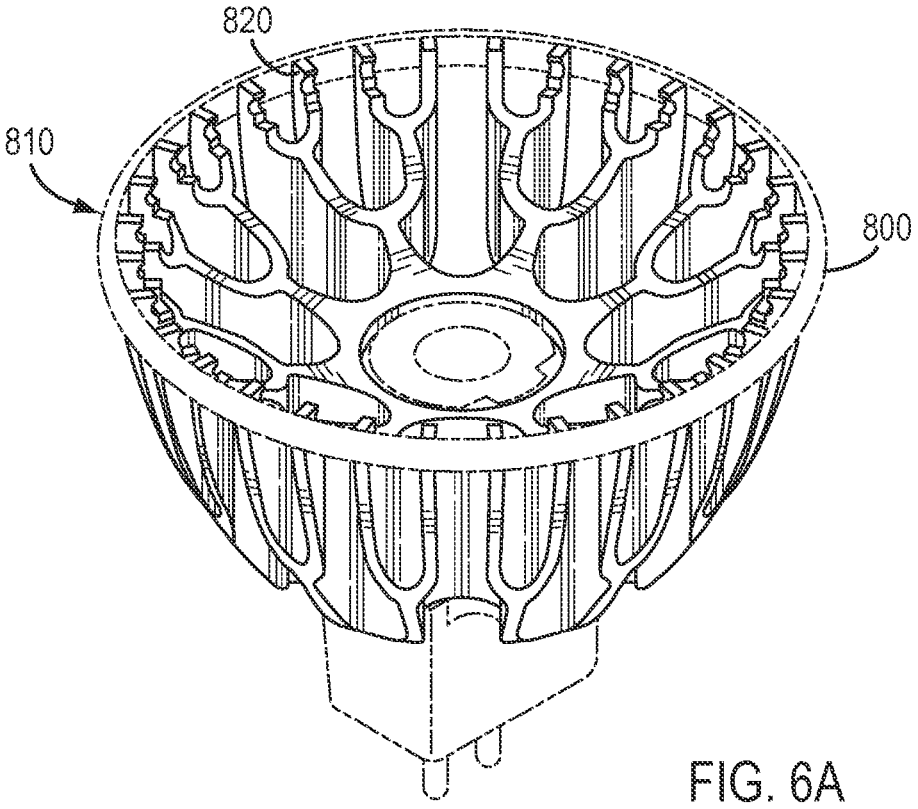
FIG. 6A and FIG. 6B illustrate various embodiments of the present disclosure.
Figure 6B:
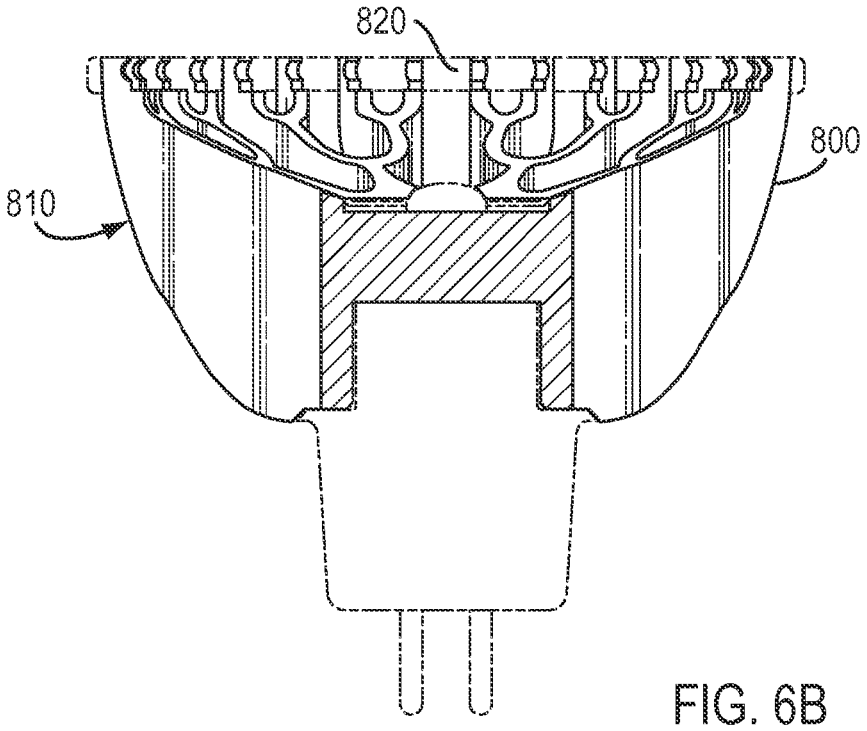

FIG. 6A and FIG. 6B illustrate embodiments of a heat sink according to certain embodiments of the present disclosure. More specifically, FIG. 6A illustrates a perspective view of a heat sink, and FIG. 6B illustrates a cross-section view of the heat sink.

In FIG. 6A and FIG. 6B, a heat sink 800 is illustrated including a number of heat dissipating fins 810. Additionally, fins 810 may include a mechanism for mating onto the retaining ring/optically transmissive members. As illustrated in the example in FIG. 6A and FIG. 6B, the mating mechanism includes indentations 820 on fins 810. In some embodiments, each of fins 810 may include an indentation 820, whereas in other embodiments, less than all of fins 810 may include an indentation. In other embodiments, the mating mechanism may include the use of an additional clip, a clip on the reflective optics, or the like.

Figure 7:
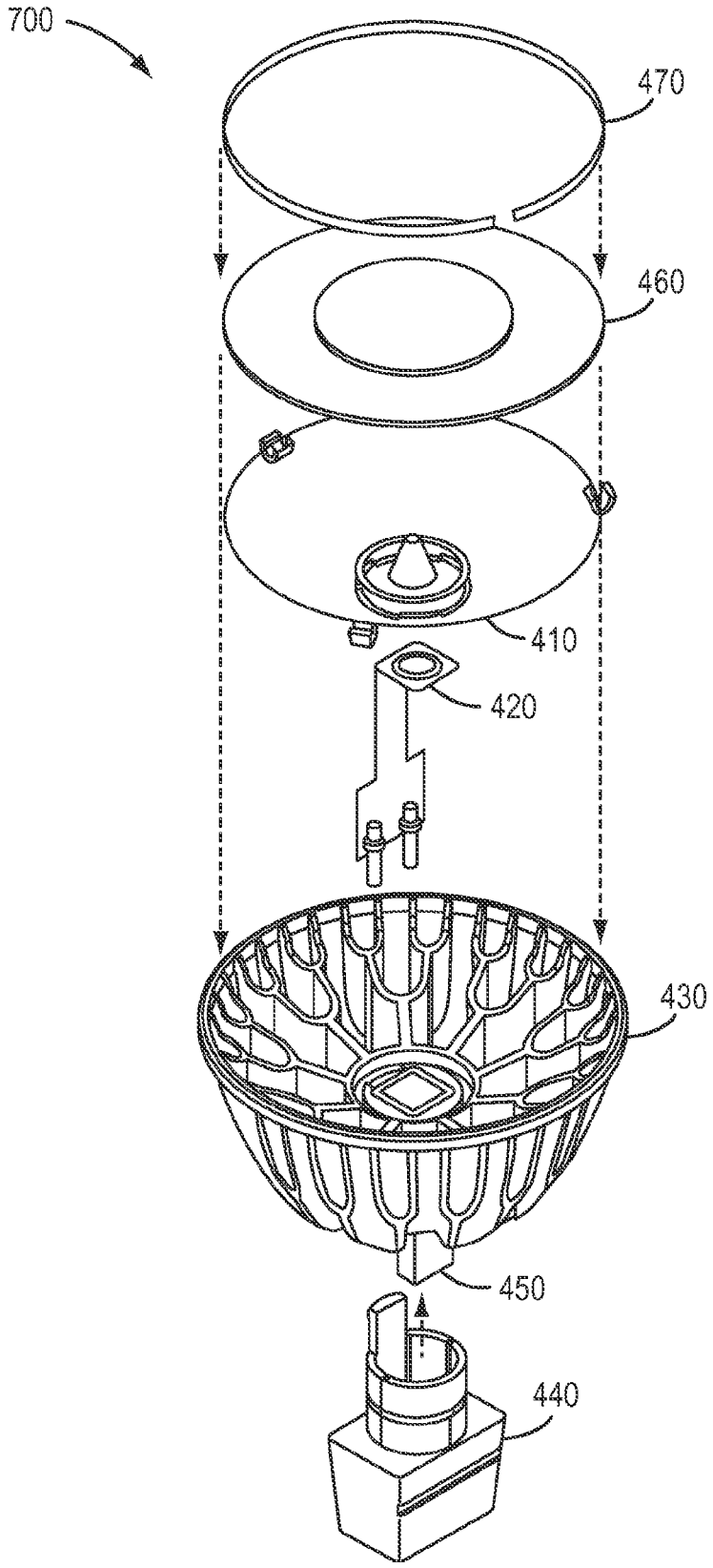
FIG. 7 depicts an exploded view of an LED lamp with multiple accessories according to certain embodiments of the present disclosure.

FIG. 7 depicts other arrangements of accessories for LED lamps.

In certain embodiments, the optically transmissive members may be coupled to an intermediate grille, or the like that is coupled to the heat sink and/or reflective lens. Accordingly, embodiments of the present disclosure are applicable for use in wide-beam light sources or in narrow-beam light sources.

Figure 8A:
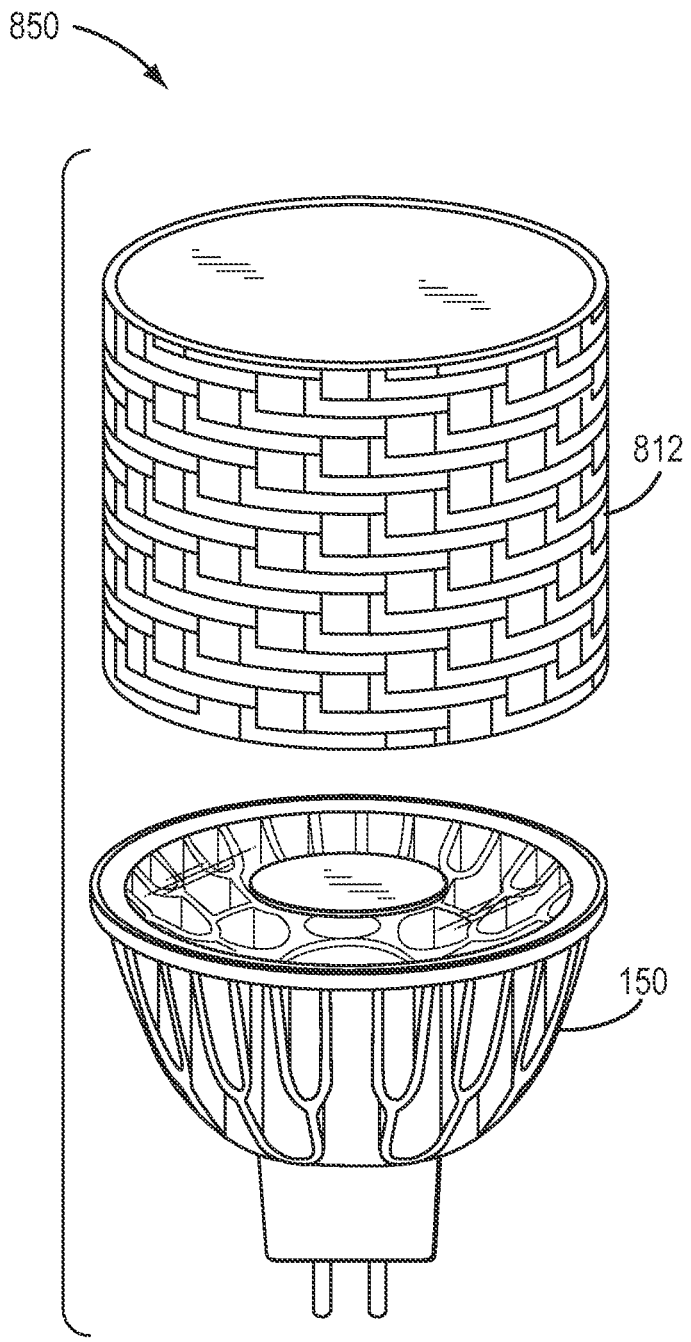
FIG. 8A depicts an arrangement of a collimator for an LED lamp according to certain embodiments of the present disclosure.

FIG. 8A depicts an arrangements of a collimator 812 for LED lamps. The arrangement 850 shows an LED lamp 150 comprising a lens having a center and a diameter to which is attached a first magnet so as to accommodate a collimator accessory where the collimator accessory is disposed on the lens and held in place by a second magnet $\mathbf{102}_2$ attached to the center of the collimator accessory (see FIG. 8B).

Figure 8B:
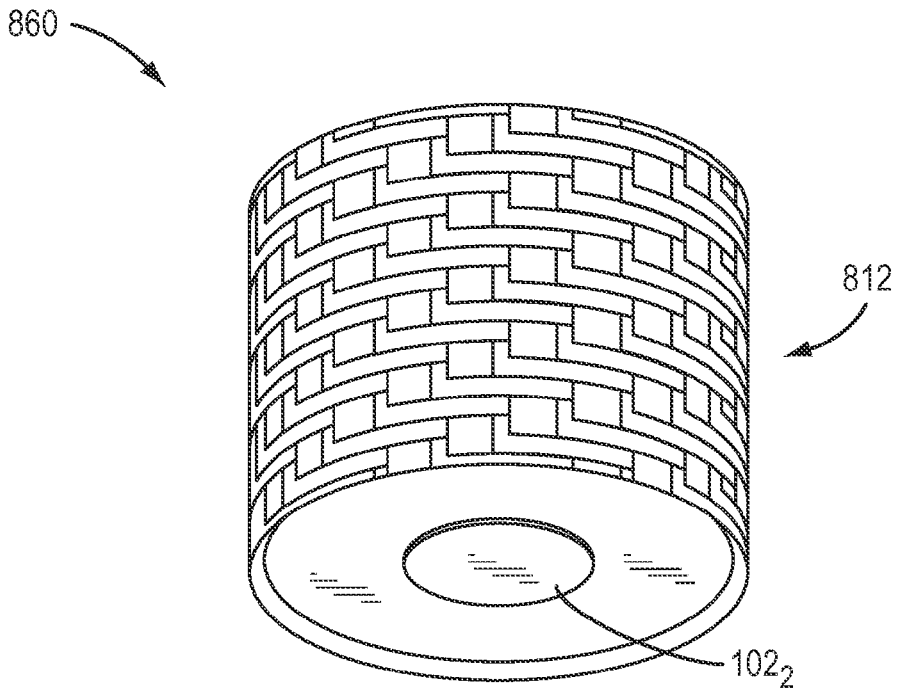
FIG. 8B is a perspective view of a collimator for an LED lamp, according to certain embodiments of the present disclosure.

FIG. 8B is a rear-view 860 of a collimator design for LED lamps. In the configuration shown, the collimator is operable for blocking side-emanating light. The surfaces of the collimator may be textured or polished, or anodized, or painted for ornamental or other purposes.

Figure 8C:
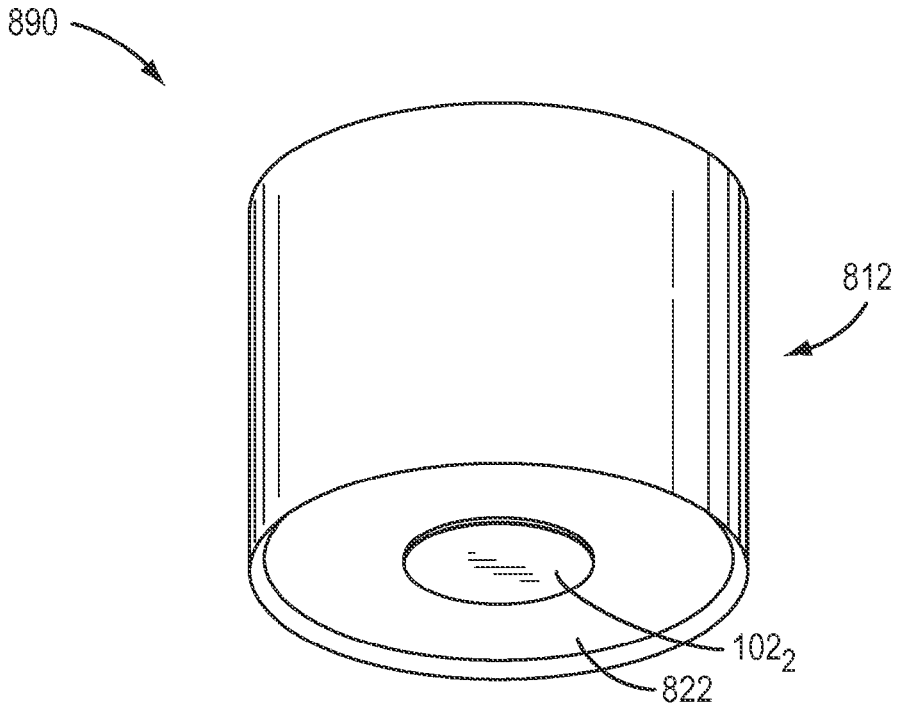
FIG. 8C is a perspective view of a collimator for an LED lamp according to certain embodiments of the present disclosure.

FIG. 8C is a rear-view 890 of a collimator design for LED lamps. In the configuration shown, the collimator is operable for blocking side-emanating light, and includes a magnet $\mathbf{102}_2$ affixed to a diffuser 822, which is integrated into the collimator 812.

Figure 9A:
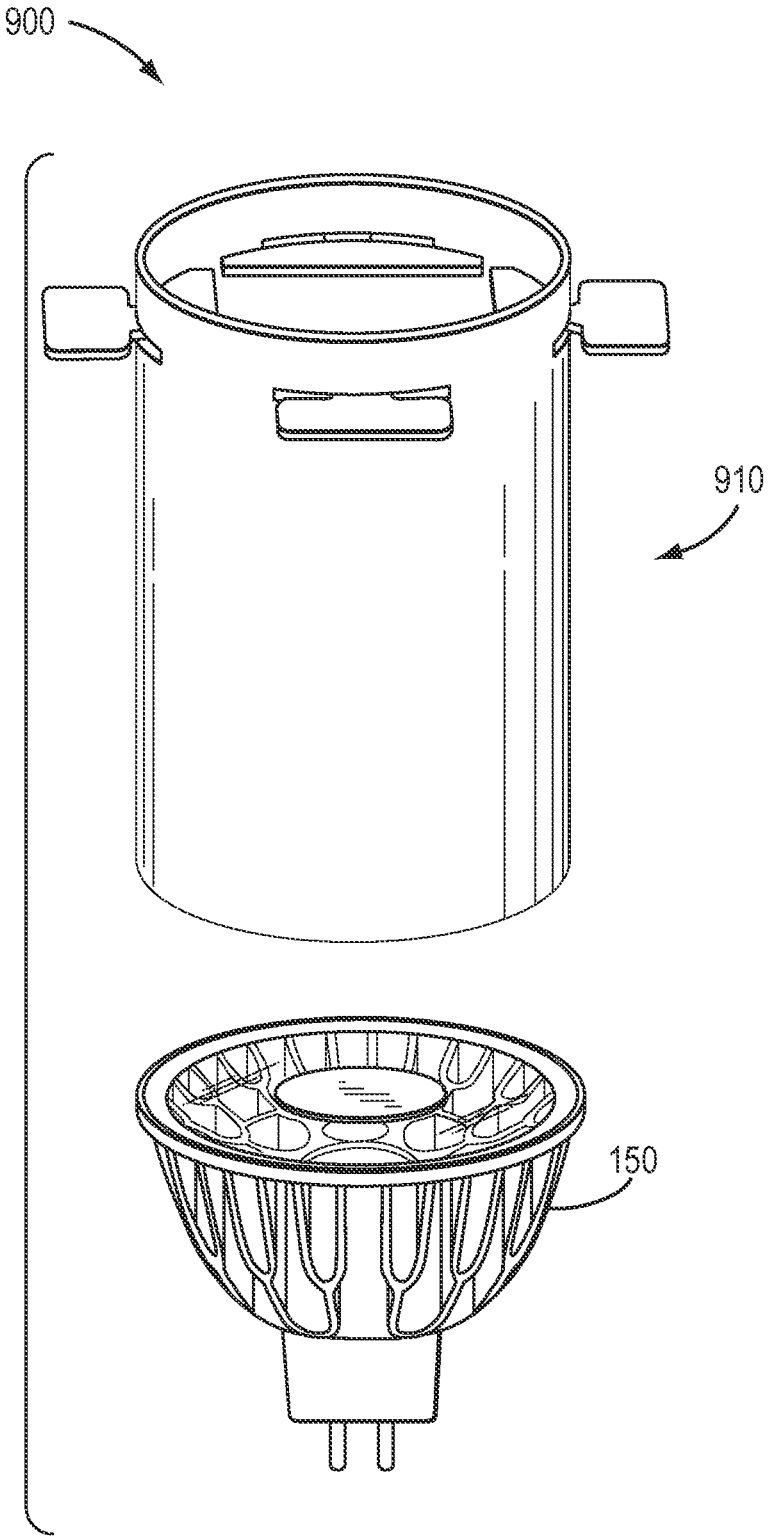
FIG. 9A depicts a projector accessory for an LED lamp according to certain embodiments of the present disclosure.

FIG. 9A depicts an arrangement 900 of a projector accessory 910 for LED lamps. The term "projector accessory" as used herein refers to an accessory attached to an LED lamp or other LED light source. As shown the projector accessory 910 is attached to an LED lamp by means of magnetic attraction (also see the collimator 812 of FIG. 8A and FIG. 8B). The projector accessory 910 comprises secondary optics and adjustable baffles 903. As shown in FIG. 9A, the arrangement 900 shows an LED lamp 150 comprising a lens having a center and a diameter to which is attached a first magnet so as to accommodate a projector accessory where the projector accessory is disposed on the lens and held in place by a second magnet $\mathbf{102}_2$ attached to the center of the projector accessory (see FIG. 9B). The projector accessory 910 has an adjustable aperture and focal lens(s) that allows manipulation of the projected light beam. In some cases, the LED lamp comprises a lamp output mechanical aperture. In some cases, the LED lamp comprises a first or second lens that is configured to cover more than 90% of the lamp output mechanical aperture.

Figure 9B:
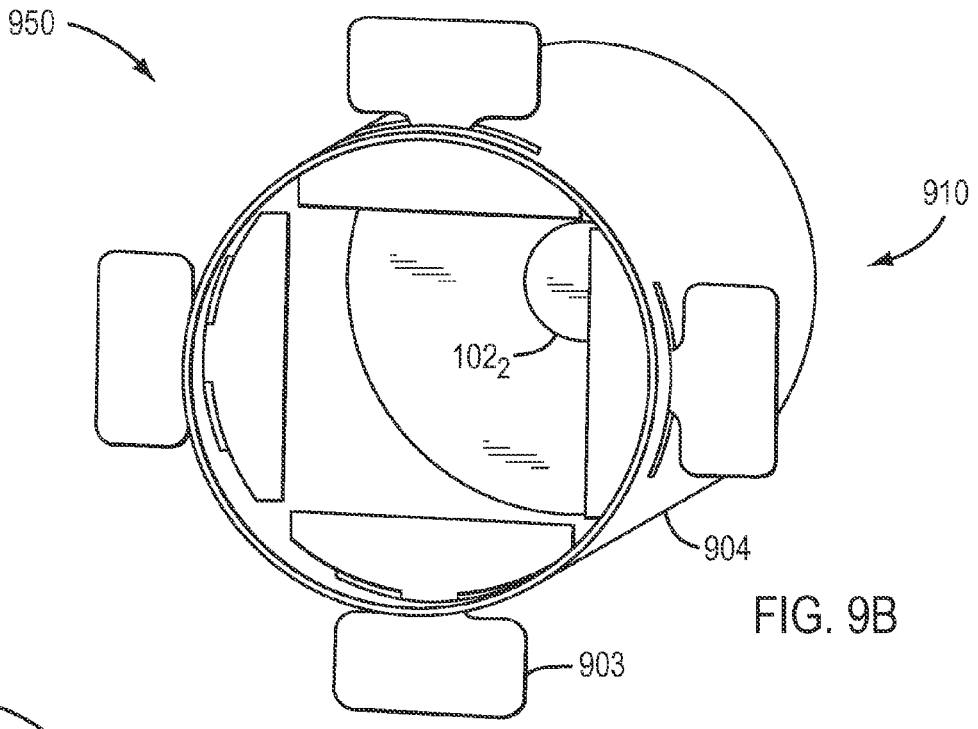
FIG. 9B is a front view of a projector accessory for an LED lamps according to certain embodiments of the present disclosure.

FIG. 9B is a front view 950 of a projector accessory 910 for LED lamps, according to various embodiments of the present disclosure. As shown in FIG. 9B, the projector accessory 910 comprises a housing 904, into which are mated a plurality of adjustable baffles 903. The baffles shown are substantially rectilinear; however baffles may be formed into a non-rectangular or irregular shape. Furthermore, some embodiments of projector accessory 910 have one or more focal lens(s) that provide for manipulation of the projected light beam so as to focus a pattern on a surface (e.g., a wall, a painting, a door) that is positioned at a pre-determined length from the focal lens.

Figure 9C:
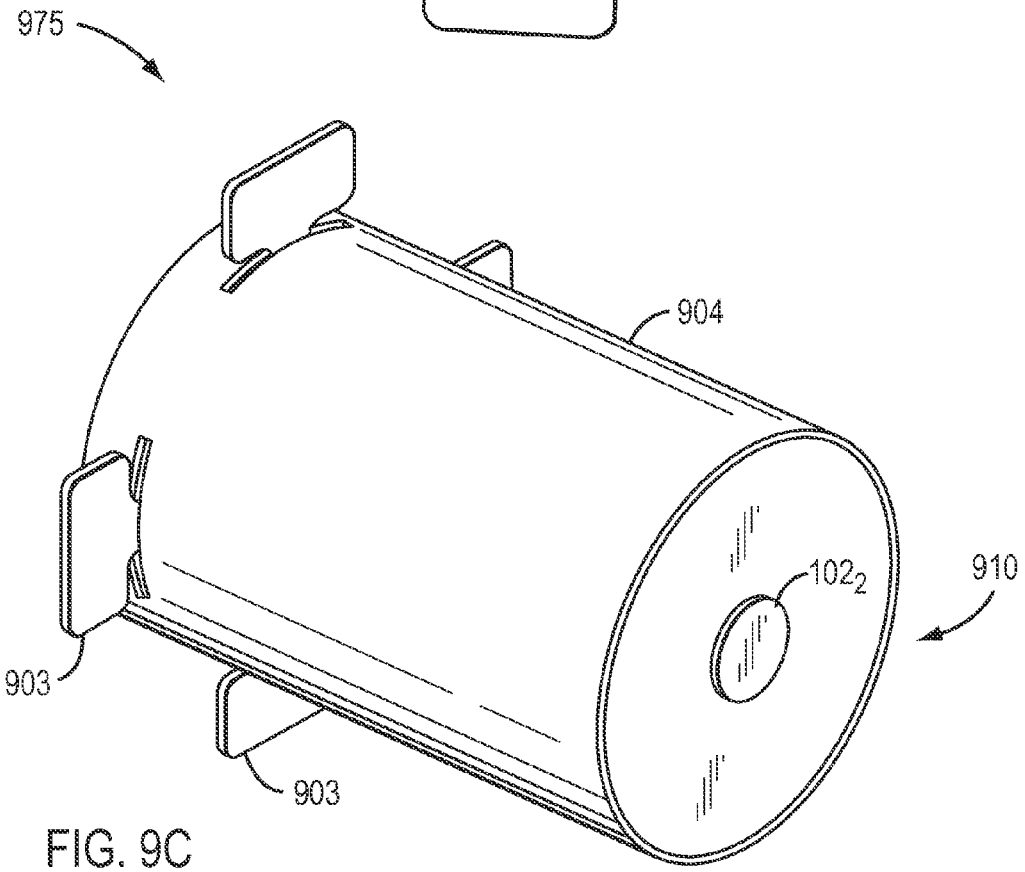
FIG. 9C is a side view of a projector accessory for an LED lamps according to certain embodiments of the present disclosure.

FIG. 9C is a side view 975 of a projector accessory for LED lamps. The rear view shows magnet $\mathbf{102}_2$.

Figure 10:
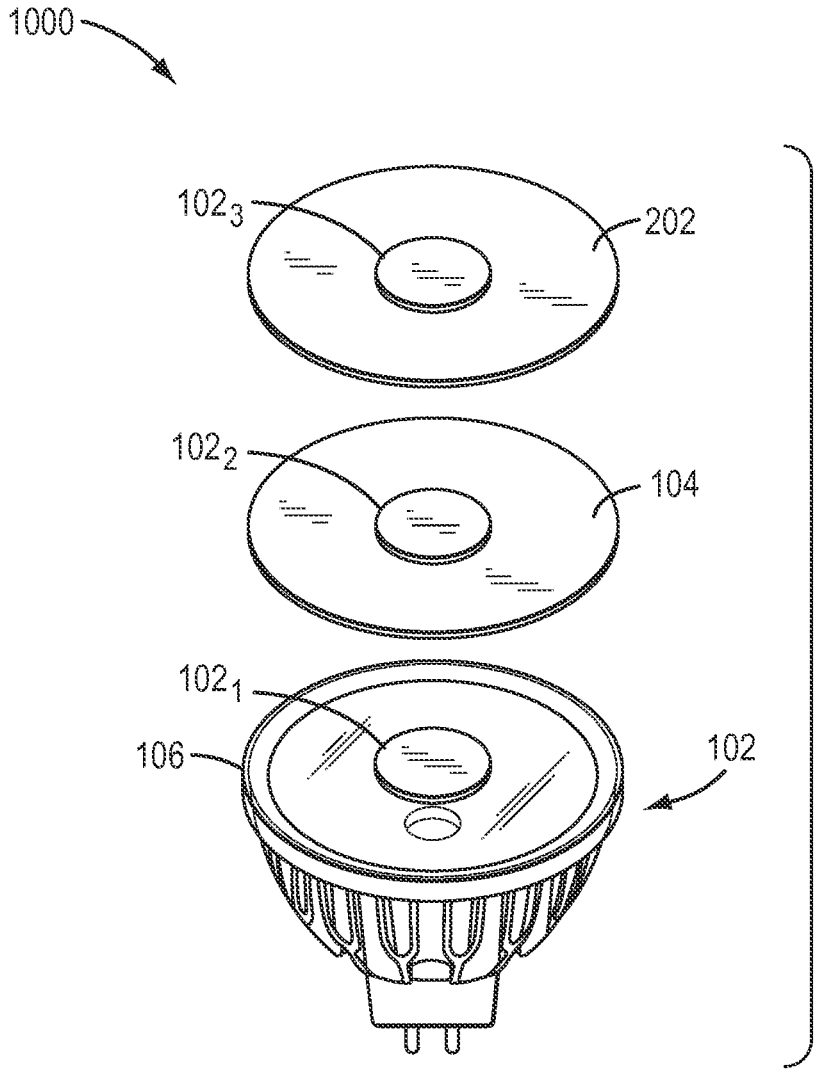
FIG. 10 is an exploded view of an LED lamp having magnet accessories according to certain embodiments of the present disclosure.

FIG. 10 is an exploded view 1000 of an embodiment of the present disclosure. As shown, an LED lamp is affixed to a lens 106 having a center and a diameter for mating to a first magnet $\mathbf{102}_1$ attached to the center of the lens 106. A first accessory 104 is disposed over the lens 106; using a second magnet $\mathbf{102}_2$ mechanically attached to the center of the first accessory 104. The first magnet $\mathbf{102}_1$ and the second magnet $\mathbf{102}_2$ are configured to retain the first accessory 104 against the lens 106. A second accessory 202 is disposed over the first accessory 104; using a third magnet $\mathbf{102}_3$ mechanically attached to the center of the second accessory 202.

Figure 11A:
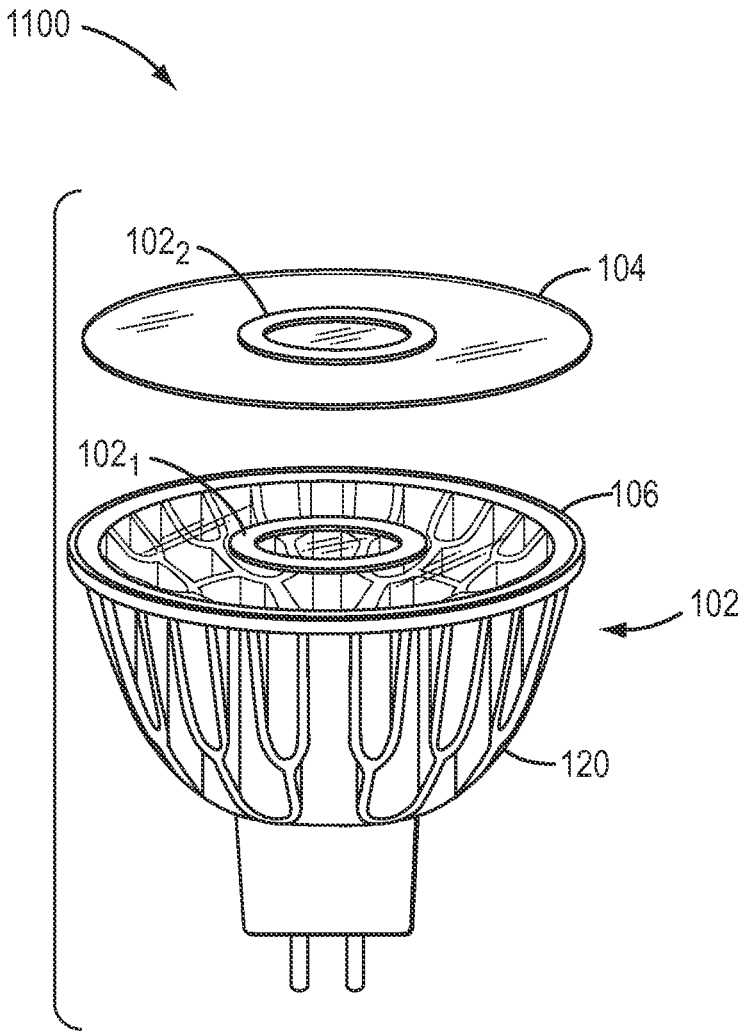
FIG. 11A is a top elevation view of an LED lamp assembly having magnet accessories according to certain embodiments of the present disclosure.

FIG. 11A is a top elevation view 1100 of an LED lamp assembly. As shown in FIG. 11A, a lens 106 is attached to a heat sink 120. The design of lens 106 includes a magnet (e.g., a ring-shaped or doughnut magnet $\mathbf{102}_3$), which can hold accessory 104 to the lens 106. The first magnet (doughnut magnet $\mathbf{102}_1$) and second magnet (e.g., $\mathbf{102}_2$) are opposing magnets that can be configured to retain the accessory 104 against the lens 106. For example, the opposing magnets $\mathbf{102}_1$ and $102_2$ may have the opposite polarity. Moreover the shape and position of the opposing magnets is such that an attachment is self-centering with respect to the lens 106 upon installation.

Figure 11B:
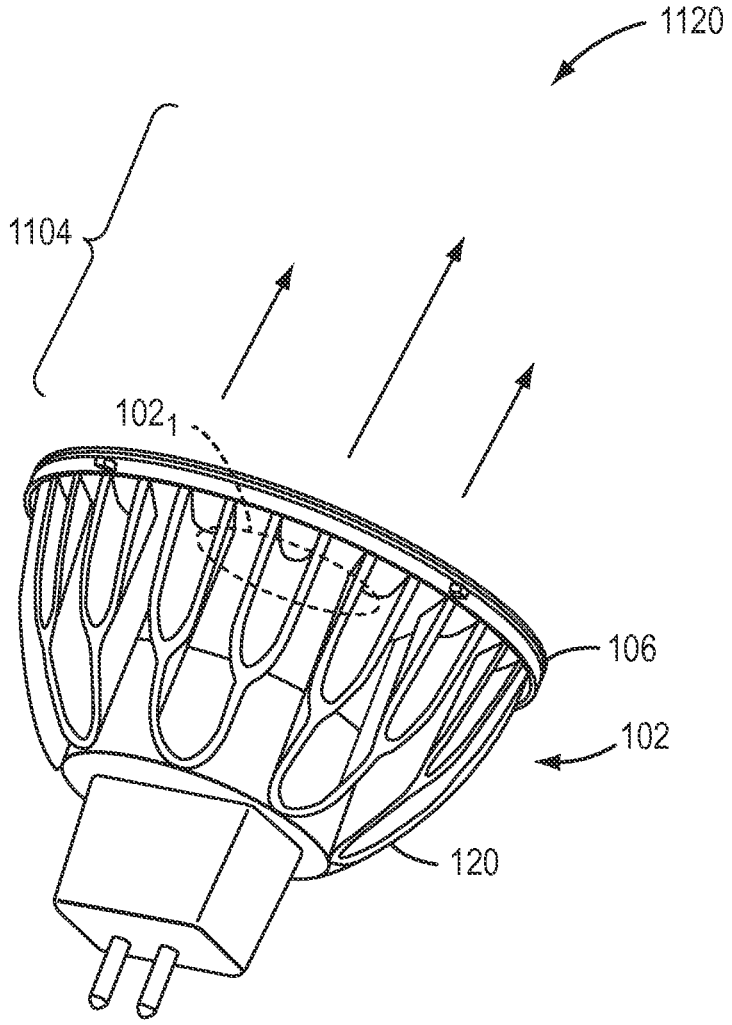
FIG. 11B is a rear elevation view of an LED lamp assembly having magnet accessories according to certain embodiments of the present disclosure.

FIG. 11B is a rear elevation view 1120 of an LED lamp assembly. As shown, the doughnut magnet $102_1$ is shaped and affixed to lens 106 in a particular position so as to occlude only a portion of the light emanating from the LED light source. In certain embodiments, the shape and position of the doughnut magnet serves to attenuate glare (see emanated light pattern 1104).

Figure 11C:
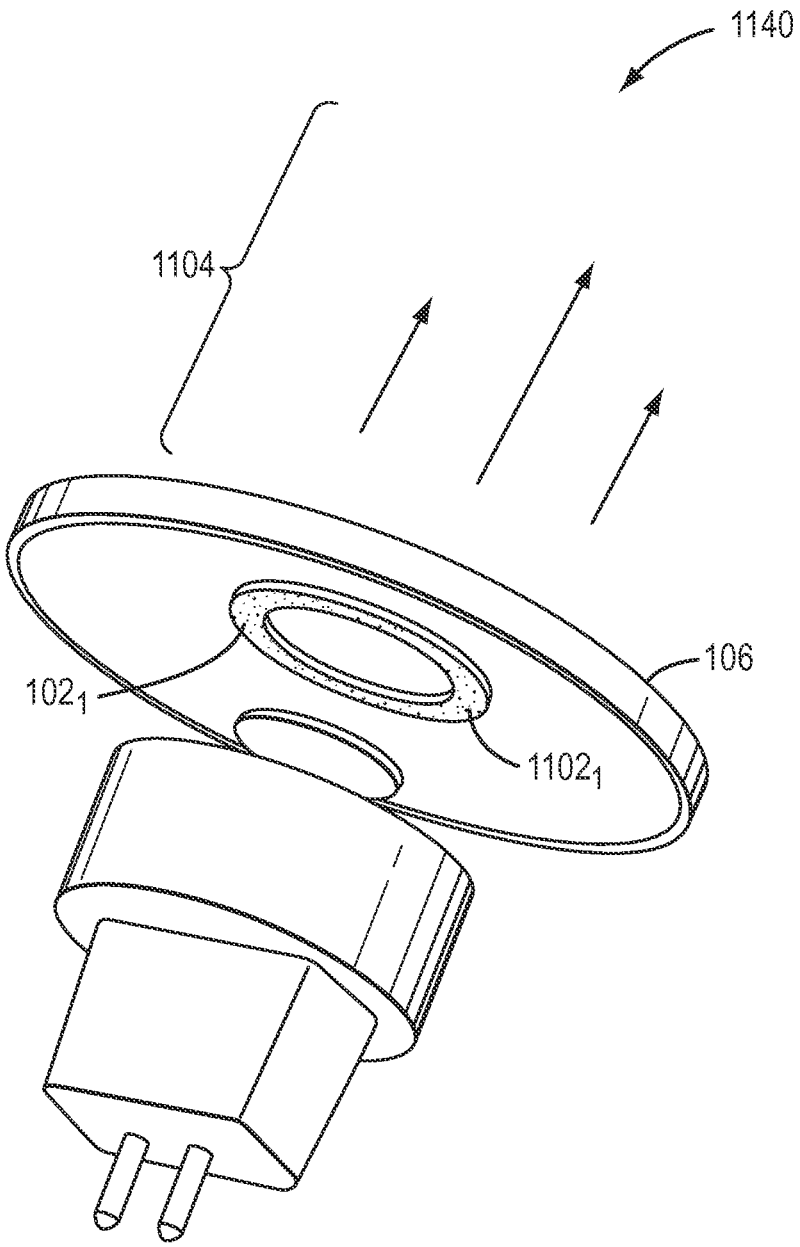
FIG. 11C is a rear cutaway view of an LED lamp assembly having magnet accessories according to certain embodiments of the present disclosure.

FIG. 11C is a rear cutaway view 1140 of an LED lamp assembly. As shown, the doughnut magnet $102_1$ is shaped and affixed to lens 106 in a particular position so as to reflect a portion of the light emanating from the LED light source back toward to general direction of the LED light source. In some embodiments, the treated surface $1102_1$ of the doughnut magnet $102_1$ is treated so as reflect light in a particular pattern and direction. A particular pattern and direction can be pre-determined, and the selection of the shape, position, and surface treatment can be tuned so as to modulate the (see emanated light pattern 1104) using the pre-determined particular pattern and direction.

FIG. 11C is a rear cutaway view 1140 of an LED lamp assembly. As shown, the doughnut magnet $102_3$ is shaped and affixed to lens 106 in a particular position so as to reflect a portion of the light emanating from the LED light source back toward to general direction of the LED light source. In some embodiments, the treated surface $1102_1$ of the doughnut magnet $102_3$ is treated so as reflect light in a particular pattern and direction. A particular pattern and direction can be pre-determined, and the selection of the shape, position, and surface treatment can be tuned so as to modulate the (see emanated light pattern 1104) using the pre-determined particular pattern and direction.

Figure 12:
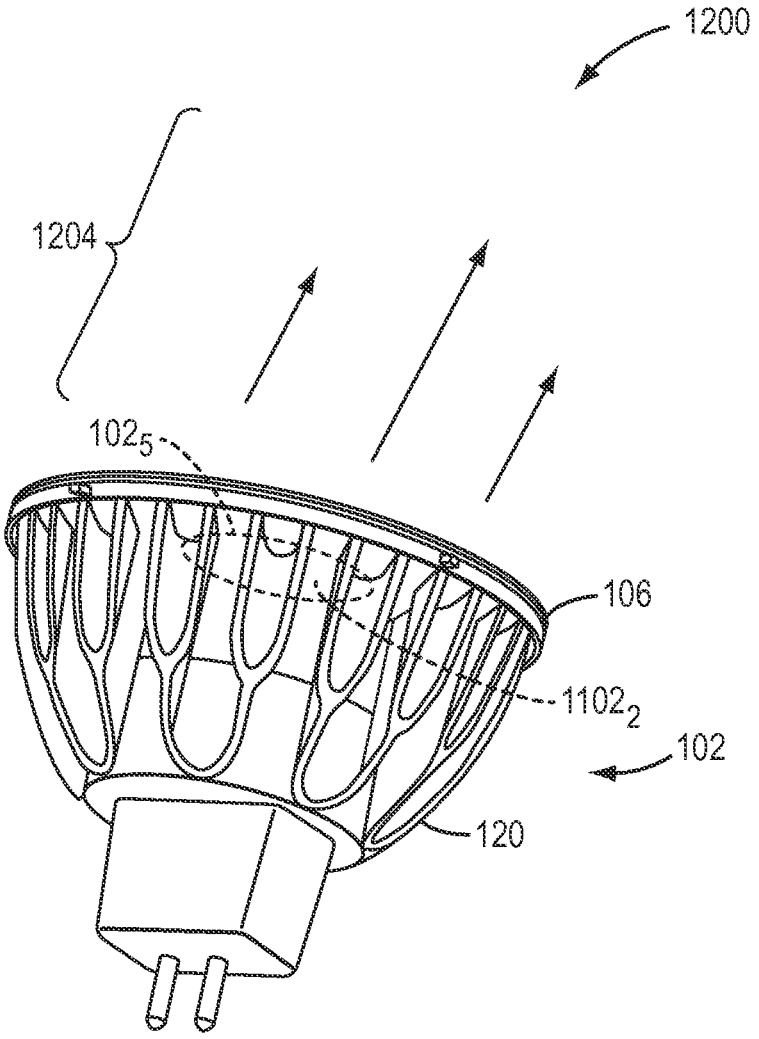
FIG. 12 is a rear elevation view of an LED lamp assembly having magnet accessories according to certain embodiments of the present disclosure.

FIG. 12 is a rear elevation view 1200 of an LED lamp assembly. As shown, the disk magnet $102_5$ is shaped and affixed to lens 106 in a particular position so as to occlude only a portion of the light emanating from the LED light source. In some embodiments, the shape and position of the disk magnet serves to attenuate glare (see emanated light pattern 1104). A particular pattern and direction can be pre-determined, and the selection of the shape, position and surface treatment of the disk magnet $102_5$ and its treated surface $1102_2$ can be tuned so as to modulate the (see emanated light pattern 1204) using the pre-determined particular pattern and direction.

Figure 13A:
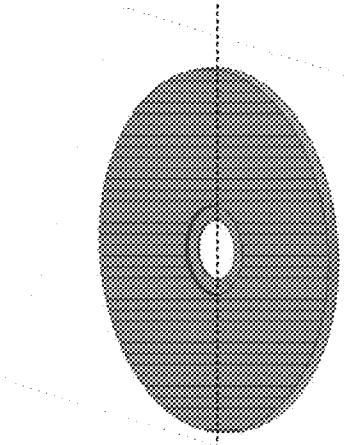
FIG. 13A is a perspective view of a beam shaping accessory and example attaching features for an LED lamp, according to some embodiments.

FIG. 13A is a perspective view of a beam shaping accessory 13A00 and example attaching features for an LED lamp. The attaching features of FIG. 13A are further described infra.

Figure 13B:
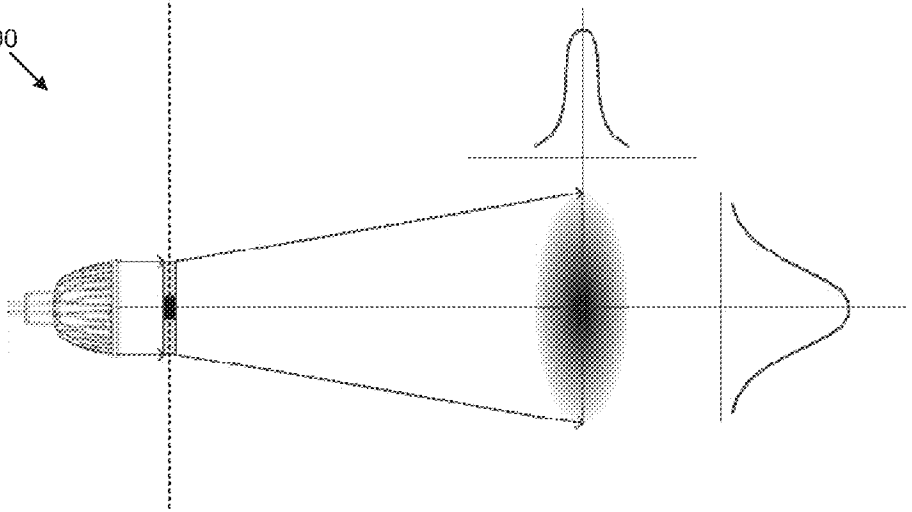
FIG. 13B is a schematic showing relative intensities of light after passing through an oval pattern beam shaping accessory as used with an LED lamp, according to some embodiments.

FIG. 13B is a schematic 13B00 showing relative intensities of light after passing through an oval pattern beam shaping accessory that has been treated to modulate an emanated light pattern as used with an LED lamp.

Figure 14:
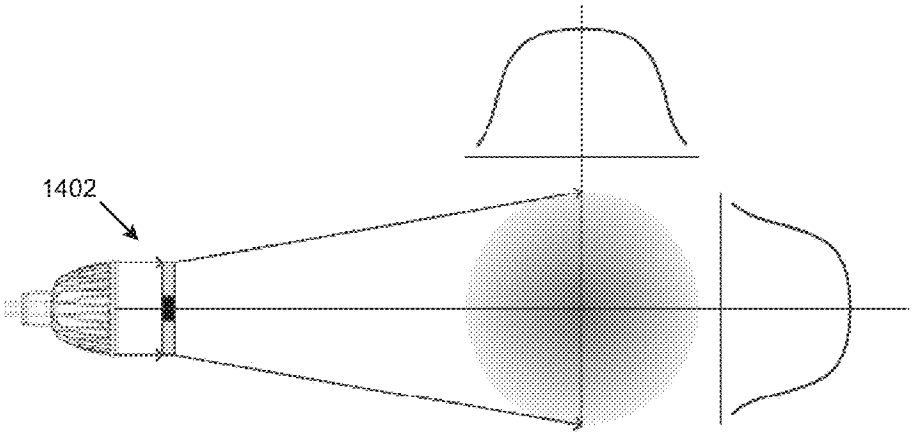
FIG. 14 is a schematic showing relative intensities of light after passing through a uniform circular beam shaping accessory as used with an LED lamp, according to some embodiments.

FIG. 14 is a schematic 1400 showing relative intensities of light after passing through a uniform circular beam shaping accessory 1402 as used with an LED lamp.

Figure 15:
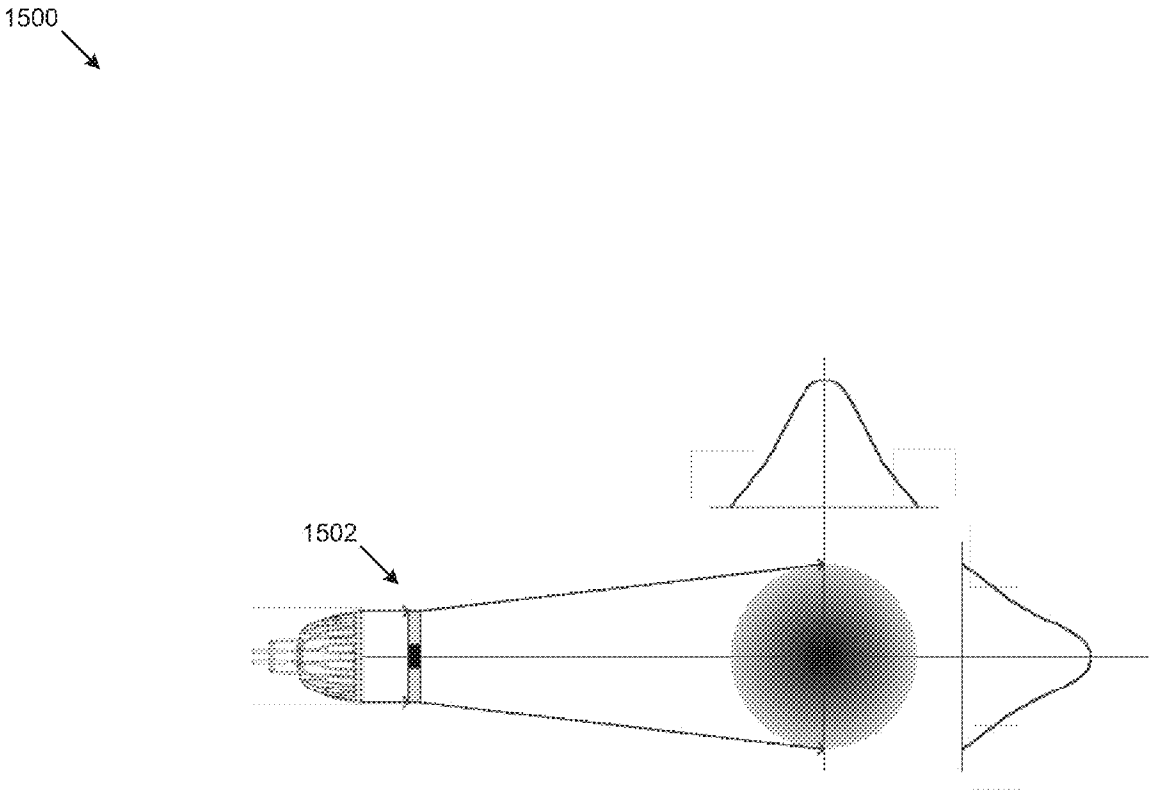
FIG. 15 is a schematic showing relative intensities of light after passing through a center-weighted circular beam shaping accessory as used with an LED lamp, according to some embodiments.

FIG. 15 is a schematic 1500 showing relative intensities of light after passing through a center-weighted circular beam shaping accessory 1502 as used with an LED lamp.

Figure 16:
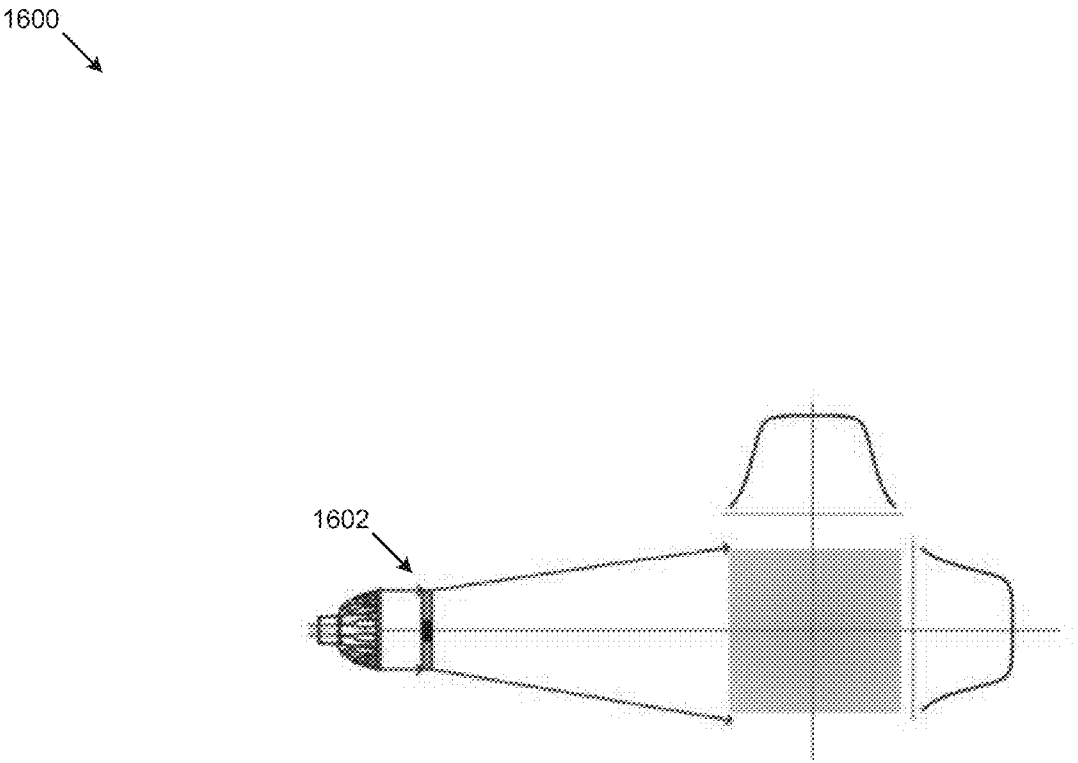
FIG. 16 is a schematic showing relative intensities of light after passing through a rectangular pattern beam shaping accessory as used with an LED lamp, according to some embodiments.

FIG. 16 is a schematic 1600 showing relative intensities of light after passing through a rectangular pattern beam shaping accessory 1602 as used with an LED lamp.

Figure 17:
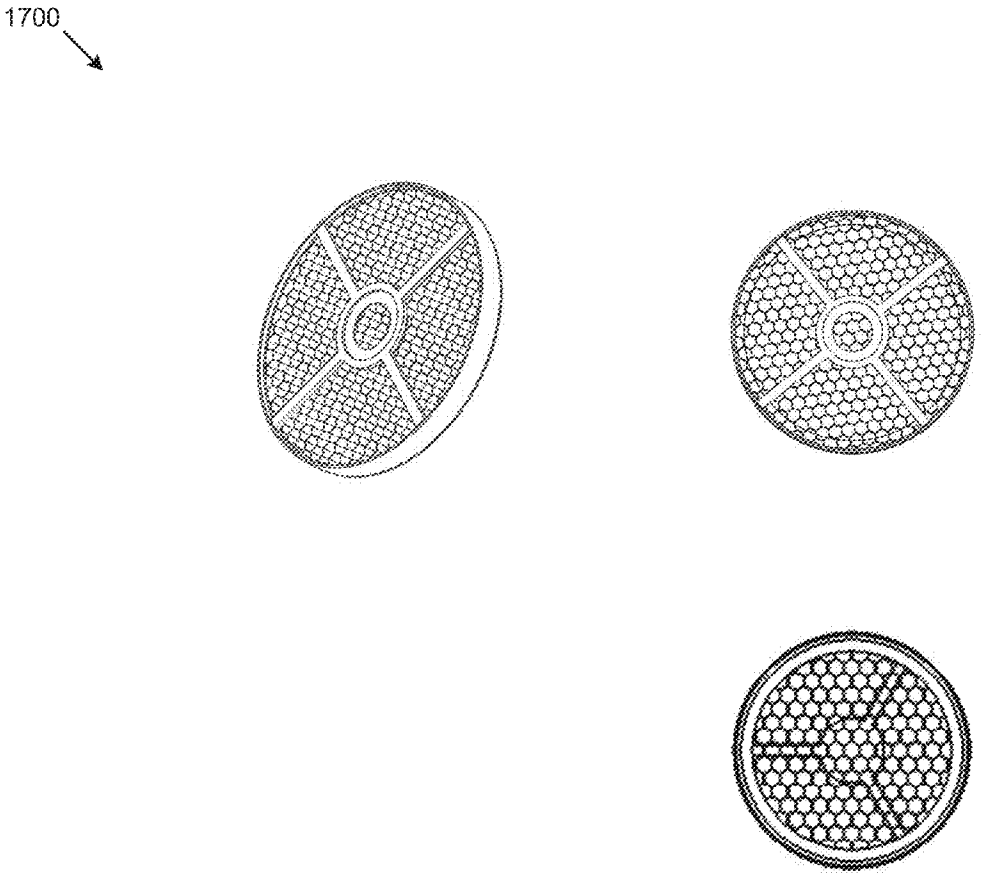
FIG. 17 presents views of a honeycomb louver accessory and attach features as used with an LED lamp, according to some embodiments.

FIG. 17 presents views of a honeycomb louver accessory 1700 and attach features as used with an LED lamp. The honeycomb shape of the accessory is used to cancel the incident glare from the light source and to direct the light to a specific area of interest.

Figure 18:
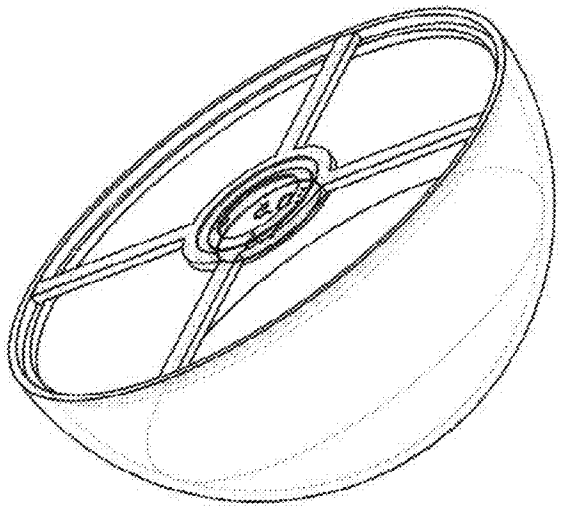
FIG. 18 presents a perspective view of a half dome diffuser accessory and attach features as used with an LED lamp, according to some embodiments.

FIG. 18 presents a perspective view of a half dome diffuser accessory 1800 that can serve to block the glare from the light source 1800. Also shown are attach features as used with an LED lamp.

Figure 19:
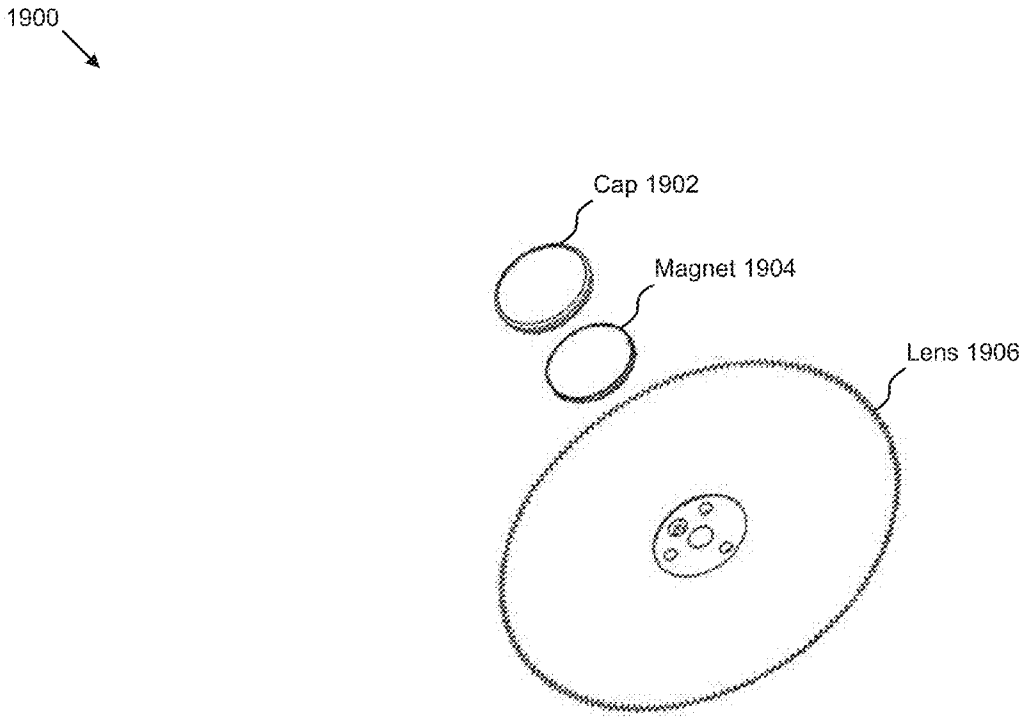
FIG. 19 is an exploded view of components in an assembly of a prism lens configured for use with an LED lamp, according to some embodiments.

FIG. 19 is an exploded view of components in an assembly of a prism lens 1900 configured for use with an LED lamp.

Various techniques could be utilized to secure the magnet to a lens or to the aforementioned accessories. Such techniques are not limited to one or another of the various methods. Non-limiting examples are:

Mold in place: This technique relies in part on geometry that is suitable for molding process. In some embodiments, the magnet is captured into place during an injection process.

Press-On: This technique relies at least in part on the friction and/or cohesion and/or adhesion between the magnet and the lens (or the magnet and the accessory) to hold the magnet in place. In certain applications, snap tabs can be utilized to flex open and snap-hold the magnet in place.

Glue: Various types of glue techniques are often capable of holding the magnet in place. An adhesive holds the magnet in place on the lens or the accessories. Depending on the material finish and temperature, various types of adhesive can be used to secure the magnet to other parts.

Ultra-sonic Weld: Ultra-Sonic welding (US) is a process used to attach the magnet to the lens or to the accessories. The US process utilizes a thin plastic cap 1920 to encapsulate a magnet (e.g., magnet 1904, as shown) onto the lens or the accessory (e.g., lens 1906). In the shown embodiment, the internal geometry of the accessory is designed so as to allow the same cap to enshroud magnets of different thickness. In some cases such an arrangement is employed in order to affix a magnet to either a lens or to an accessory.

One aspect of affixing a magnet to a lens is the lens light efficiency. Therefore the pocket on the lens should be only as deep as necessary. A thin magnet is used for the specific application of affixing the magnet on the face of the lens. As shown, the cap geometry is designed to encapsulate the thin magnet on the lens (which assembly is shown in FIG. 20).

Figure 20:
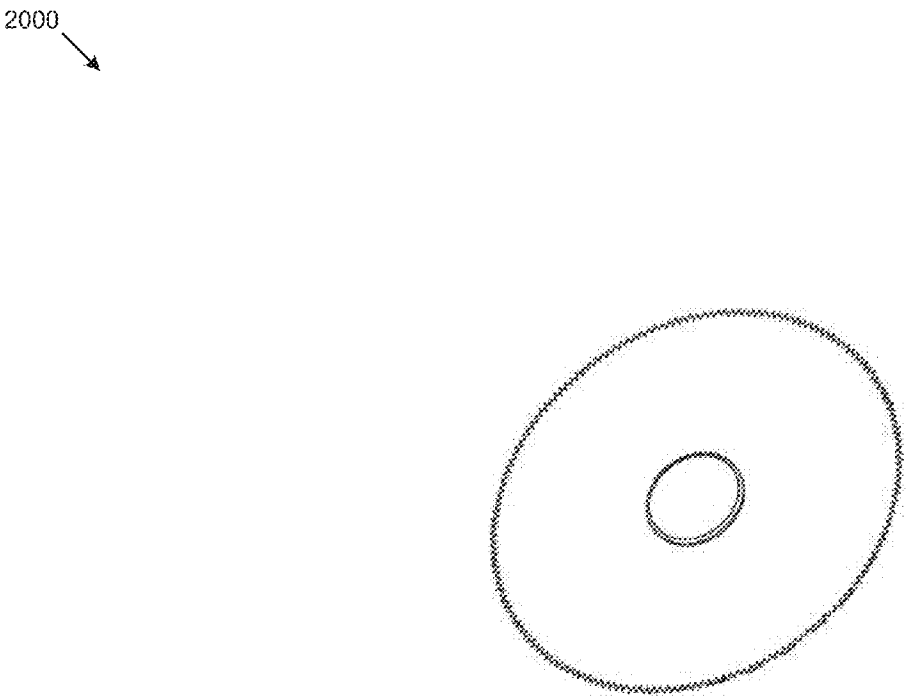
FIG. 20 shows an assembly of components to form a prism lens configured for use with an LED lamp, according to some embodiments.

FIG. 20 shows an assembly of components to form a prism lens 2000 configured for use with an LED lamp.

Figure 21:
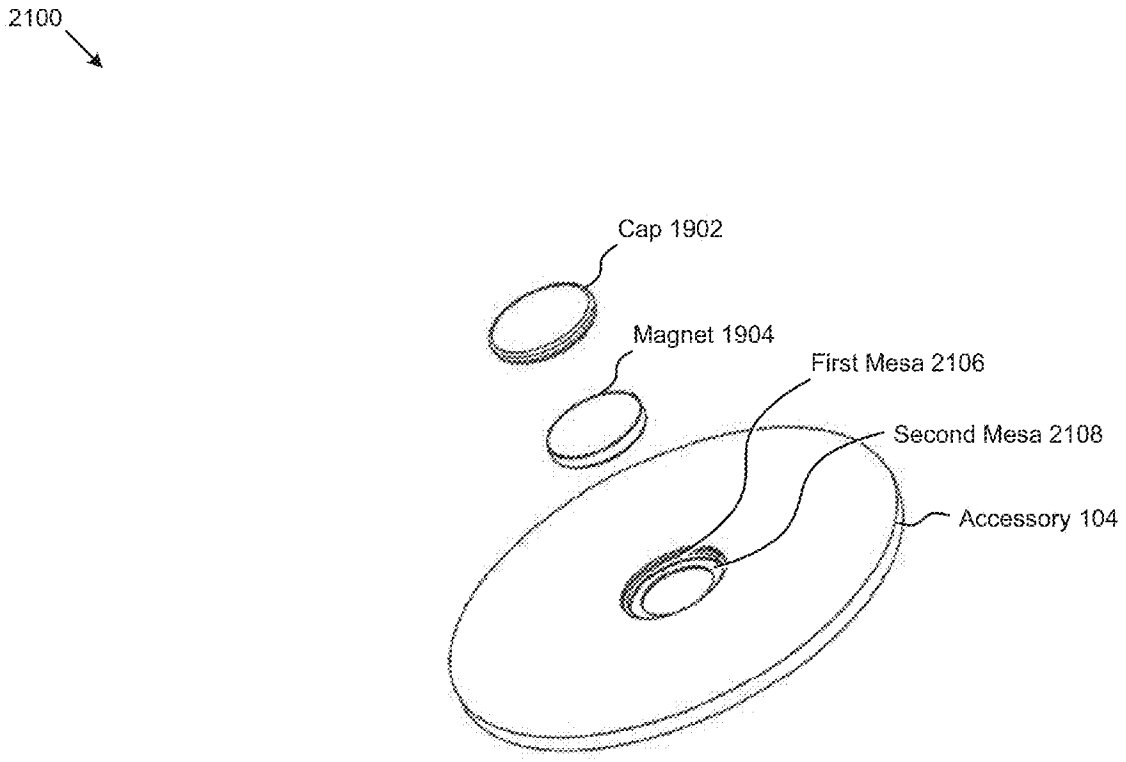
FIG. 21 is an exploded view of components in an assembly of a filter configured for use with an LED lamp, according to some embodiments.

FIG. 21 is an exploded view of components in an assembly of an accessory or a filter 2100 configured for use with an LED lamp.

The accessory shown has progressive pockets (e.g., having a first mesa 2106 and a second mesa 2108) for receiving the magnet, and for receiving the cap. For example, the magnet is placed in the pocket, then the cap is placed on top on top of the magnet, where the edges of the cap makes contact with a pocket. This assembly is then placed in an ultra-sonic welding machine that joins the cap to the accessory. Different thickness of magnets can be used. In some cases a different thickness is used for the accessory as compared with the thickness used for the lens.

In some cases the pockets are designed such that the same cap can be used to encapsulate the magnet on either the lens or the accessory.

Figure 22:
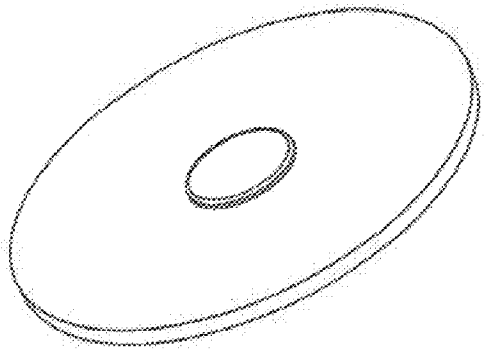
FIG. 22 shows an assembly of components to form a filter configured for use with an LED lamp, according to some embodiments.

FIG. 22 shows an assembly of components to form a filter 2200 such as, for example, a color filter or a polarizer, configured for use with an LED lamp.

In certain embodiments, an illumination source is configured to output light having a user-modifiable beam characteristic. Such an illumination source comprises an LED light unit configured to provide a light output in response to an output driving voltage; a driving module coupled to the LED light unit, wherein the driving module is configured to receive an input driving voltage and is configured to provide the output driving voltage; a heat sink coupled to the LED light unit, wherein the heat sink is configured to dissipate heat produced by the LED light unit and by the driving module; a reflector coupled to the heat sink, wherein the reflector is configured to receive the light output, and wherein the reflector is configured to output a first light beam having a first beam characteristic; and a lens coupled to the heat sink, wherein the lens is configured to receive the first light beam having the first beam characteristic, and wherein the lens is configured to output a second light beam having a second beam characteristic; wherein the lens is selected by the user to achieve the second beam characteristic; and wherein the lens is coupled to the heat sink by the user.

In certain embodiments, such as the immediately preceding embodiment, an illumination source is provided comprising a transmissive optical lens; and a retaining ring coupled to the transmissive optical lens, wherein the retaining ring is configured to couple the transmissive optical lens to the heat sink.

In certain embodiments, a retaining ring comprises an incomplete circle.

In certain embodiments of an illumination source, a lens that is coupled to a heat sink is configured to require use of a tool to decouple the lens from the heat sink.

In certain embodiments of an illumination source, the intensity for the light output from the illumination source is greater than approximately 1500 candela.

In certain embodiments of an illumination source, the first beam characteristic is selected from a beam angle, a cut-off angle, a roll-off characteristic, a field angle, and a combination of any of the foregoing.

In certain embodiments of an illumination source, a heat sink comprises a plurality of heat dissipation fins; wherein at least one of the plurality of heat dissipation fins includes a retaining mechanism; and a lens is configured to be coupled to at least one of the plurality of heat dissipation fins by means of a retaining mechanism.

In certain embodiments of an illumination source, a retaining mechanism is selected from an indentation on the heat dissipation fin, a clip coupled to the heat dissipation fin, and a combination thereof.

In certain embodiments of an illumination source, a heat sink comprises an MR16 form factor heat sink.

In certain embodiments of an illumination source, a driving module comprises a GU5.3 compatible base.

Certain embodiments provided by the present disclosure include methods of providing accessories and components for assembling the accessories to a user. Certain embodiments further provide for methods of assembling accessories provided by the present disclosure.

In certain embodiments of methods for configuring a light source to provide a light beam having a user-selected beam characteristic comprise: receiving a light source, wherein the light source comprises: a LED light unit configured to provide a light output in response to an output driving voltage; a driving module coupled to the LED light unit, wherein the driving module is configured to receive an input driving voltage and is configured to provide the output driving voltage; a heat sink coupled to the LED light unit, wherein the heat sink is configured to dissipate heat produced by the LED light unit and by the driving module; and a reflector coupled to the heat sink, wherein the reflector is configured to receive the light output, and wherein the reflector is configured to output a light beam having a first beam characteristic; receiving a user selection of a lens to achieve a second beam characteristic, wherein the lens is configured to receive the light beam having the first beam characteristic and wherein the lens is configured to output a light beam having the second beam characteristic; receiving the lens in response to the user selection of the lens, separate from the light source; and coupling the lens to the light source.

In certain methods such as the immediately preceding method the lens comprises an optical lens; and a retaining ring coupled to the optical lens, wherein the retaining ring is configured to couple the optical lens to the heat sink; and wherein coupling the lens to the heat sink comprises compressing the retaining ring about the optical lens; disposing the retaining ring that is compressed within a portion of the heat sink; and releasing the retaining ring such that the retaining ring is coupled to the portion of the heat sink.

In certain embodiments of methods, the retaining ring comprises a circular shaped metal.

In certain embodiments, methods further comprise decoupling the lens from the heat sink using a tool; wherein the decoupling step requires use of a tool to decouple the lens from the heat sink.

In certain embodiments, the intensity for the light output is greater than approximately 1500 candela.

In certain embodiments of methods, the first beam characteristic is selected from a group consisting of: beam angle, cut-off angles, roll-offs characteristic, and field angle.

In certain embodiments of methods, the heat sink comprises a plurality of heat dissipation fins; wherein at least one of the plurality of heat dissipation fin includes a retaining mechanism, and wherein coupling the lens to heat sink comprises coupling the lens to the at least one heat dissipation fin via the retaining mechanism.

In certain embodiments of methods, the retaining mechanism is selected from a group consisting of: an indentation on the heat dissipation fin, and a clip coupled to the heat dissipation fin.

In certain embodiments of methods, the heat sink comprises an MR16 form factor heat sink.

In certain embodiments of methods, the driving module comprises a GU5.3 compatible base.

Further embodiments can be envisioned to one of ordinary skill in the art after reading this disclosure. In other embodiments, combinations or sub-combinations of the above disclosed disclosure can be advantageously made. The block diagrams of the architecture and flow charts are grouped for ease of understanding. However it should be understood that combinations of blocks, additions of new blocks, re-arrangement of blocks, and the like are contemplated in alternative embodiments of the present disclosure.

The specification and drawings are, accordingly, to be regarded in an illustrative rather than a restrictive sense. It will, however, be evident that various modifications and changes may be made thereunto without departing from the broader spirit and scope.

The examples describe examples of constituent elements of the herein-disclosed embodiments. It will be apparent to those skilled in the art that many modifications, both to materials and methods, may be practiced without departing from the scope of the disclosure. And, it should be noted that there are alternative ways of implementing the embodiments disclosed herein. Accordingly, the present embodiments are to be considered as illustrative and not restrictive, and the claims are not to be limited to the details given herein, but may be modified within the scope and equivalents thereof.

What is claimed is:

1. An apparatus comprising:

an LED lamp, wherein the LED lamp radiates an initial light pattern;

a lens comprising a center, wherein the lens is mechanically affixed to the LED lamp;

a first magnet, wherein the first magnet, is attached to and centered on the lens; and is configured to block at least a portion of high-angle light radiating from the LED lamp; and a first accessory comprising a second magnet, wherein, the first accessory is mated in proximity to the lens using the first magnet and the second magnet; and the second magnet is attached to and centered on the first accessory;

wherein the first magnet and the second magnet are configured to produce a retaining force between the first accessory and the lens; and wherein the first accessory is configured to control the initial light pattern to provide a radiated light pattern.

2. The LED lamp of claim 1, wherein the second magnet and the first accessory have a combined thickness less than 2 mm.

3. The LED lamp of claim 1, wherein the first magnet and/or the second magnet comprises a disk magnet.

4. The LED lamp of claim 3, wherein the disk magnet comprises at least one surface that is treated to control an emanated light pattern.

5. The LED lamp of claim 1, wherein the first magnet and/or the second magnet comprises a doughnut magnet.

6. The LED lamp of claim 5, wherein the doughnut magnet comprises at least one surface that is treated to control an emanated light pattern.

7. The LED lamp of claim 1, wherein the first accessory comprises a thin plastic film.

8. The LED lamp of claim 7, wherein the thin plastic film has a thickness less than 3 mm.

9. The LED lamp of claim 1, wherein the first accessory has a diameter that is substantially the same as a diameter of the lens.

10. The LED lamp of claim 1, wherein the first accessory is selected from a lens, a diffuser, a color filter, a polarizer, a linear dispersion element, a collimator, a projector accessory, and a combination of any of the foregoing.

11. The LED lamp of claim 1, further comprising an accessory selected from a louver, a baffle, a secondary lens, and a combination of any of the foregoing.

12. The LED lamp of claim 1, wherein the lens comprises a total internal reflection lens.

13. The LED lamp of claim 1, wherein the LED lamp is characterized by an optical aperture and the lens is configured to cover more than 90% of the optical aperture.

14. The LED lamp of claim 1, further comprising a second accessory disposed adjacent the first accessory, wherein, the second accessory comprises a third magnet;

the second accessory is mated to the first accessory using the second magnet and the third magnet; and the second magnet and the third magnet are configured to produce a magnetic retaining force between the second accessory and the first accessory.

15. The LED lamp of claim 1, wherein at least one surface of the first magnet is treated to control an emanated light pattern.

16. The LED lamp of claim 1, wherein the first accessory comprises an oval pattern beam shaping accessory.

17. The LED lamp of claim 1, wherein the first accessory comprises a square pattern beam shaping accessory.

18. The LED lamp of claim 1, wherein the first accessory comprises a rectangular pattern beam shaping accessory.

19. The LED lamp of claim 1, wherein the first accessory comprises a honeycomb louver accessory.

20. The LED lamp of claim 1, wherein the first accessory comprises a half dome diffuser accessory.

21. The LED lamp of claim 1, wherein the first magnet is attached to the lens with an ultra-sonic weld.

22. The apparatus of claim 1, wherein the radiated light pattern has reduced glare compared to the initial light pattern.

23. The apparatus of claim 1, wherein the first magnet comprises a reflective coating configured to reflect high angle light toward the LED light source.

24. The apparatus of claim 1, wherein the first magnet comprises a coating configured to absorb light.

25. The apparatus of claim 1, wherein the first magnet and the second magnet are configured to attenuate glare.

26. The apparatus of claim 1, wherein the lens comprises a pocket and the first magnet is disposed within the pocket.

* * * * *